US005878825A

United States Patent [19]

Okuyama et al.

[11] Patent Number: 5,878,825

[45] Date of Patent: Mar. 9, 1999

[54] UNDERGROUND PROPELLING METHOD

[75] Inventors: Shigeaki Okuyama; Teruo Kabeuchi; Katsuhiko Mukuno; Masaya Hattori; Kazunori Tsujimoto; Takashi Togawa; Yukishige Yamada; Masao Nakagawa; Siro Sugiyama, all of Amagasaki, Japan

[73] Assignee: Kubota Corporation, Japan

[21] Appl. No.: 886,220

[22] Filed: Jul. 1, 1997

[30] Foreign Application Priority Data

| | | | |
|---|---|---|---|
| Jul. 3, 1996 | [JP] | Japan | 8-173190 |
| Sep. 3, 1996 | [JP] | Japan | 8-232708 |
| Sep. 24, 1996 | [JP] | Japan | 8-251075 |
| Sep. 30, 1996 | [JP] | Japan | 8-258336 |

[51] Int. Cl.[6] ..... E21B 7/06

[52] U.S. Cl. ..... 175/61; 175/45

[58] Field of Search ..... 175/61, 45, 62, 175/73

[56] References Cited

U.S. PATENT DOCUMENTS

| | | | |
|---|---|---|---|
| 2,687,282 | 8/1954 | Sanders | 175/61 |
| 3,712,391 | 1/1973 | Coyne | 175/61 |
| 4,062,196 | 12/1977 | Yoshida et al. | 175/61 |
| 4,442,908 | 4/1984 | Steenbock | 175/61 |
| 4,523,652 | 6/1985 | Schuh | 175/61 |
| 5,085,283 | 2/1992 | Seabourn et al. | 175/61 |
| 5,163,520 | 11/1992 | Gibson et al. | 175/61 |
| 5,542,482 | 8/1996 | Eddison | 175/61 |

*Primary Examiner*—Hoang C. Dang
*Attorney, Agent, or Firm*—Webb Ziesenheim Bruening Logsdon Orkin & Hanson, P.C.

[57] ABSTRACT

An underground propelling method uses a propellant apparatus including a propellant head having a pressure receiving face portion inclined relative to an axis of the head and a plurality of propellant cylinders flexibly and pivotally connected in series to a rear end of the propellant head. The propellant apparatus is propelled under the ground by applying a thrust to the propellant apparatus from behind. Each propellant cylinder of the apparatus is pivotal about a single pivot axis thereof alone. The apparatus is propelled with the pressure receiving face portion thereof being oriented along a pivotal direction of the propellant cylinder about the pivot axis.

18 Claims, 29 Drawing Sheets

(b)

UNDERGROUND PROPELLING METHOD

BACKGROUND OF THE INVENTION

1. Field of the Invention

The present invention relates to the art of digging a hole under the ground for installing an underground pipe such as a gas pipe, cable pie or water pipe. More particularly, the invention relates to a method using a propellant apparatus including a propellant head having a pressure-receiving face portion inclined relative to a head axis and a plurality of propellant cylinders pivotally and flexibly connected to the rear end of the propellant head and propelling the propellant apparatus under the ground by applying a thrust to the propellant apparatus from behind.

2. Description of the Related Art

The propellant apparatus is propelled in the earth as the pressure receiving face thereof receives the reaction force from the ground in association with the propellant movement, with the apparatus being guided to be flexed in the direction of the reaction force. Conventionally, in this type of underground propelling method, the propellant apparatus is constructed to be omnidirectionally flexible, so that in a curved propelling area the apparatus is propelled with its pressure receiving face portion being kept oriented to the opposite direction to the flexing direction. In a straight propelling area, on the other hand, the apparatus is propelled along a zig-zag path substantially along the planned straight path by reversibly switching over the orientation of the pressure receiving face portion.

With the above-described conventional method, as the propellant apparatus is omnidirectionally flexible, the apparatus can be propelled in any direction. On the other hand, if the orientation of the pressure receiving face portion is deviated from the planned direction and the apparatus is propelled under this condition, the apparatus will advance in this deviated direction. Accordingly, the steering control tends to be complicated.

The same problem as above may occur when the apparatus is propelled along a straight path, as the apparatus is apt to be flexed inadvertently. Each time the apparatus is deviated from the planned straight path, control becomes necessary to return the apparatus to the planned path. Hence, in this case too, the steering control tends to be complicated.

Then, a primary object of the present invention is to provide an underground propelling method capable of propelling the propellant apparatus along a planned path with high precision without necessitating complicated steering control scheme, thus solving the above-described drawbacks of the conventional method.

SUMMARY OF THE INVENTION

For fulfilling the above-noted object, an underground propelling method, according to one aspect of the present invention, comprises the steps of:

using a propellant apparatus including a propellant head having a pressure receiving face portion inclined relative to an axis of the head and a plurality of propellant cylinders flexibly and pivotally connected in series to a rear end of the propellant head; and propelling the propellant apparatus under the ground by applying a thrust to the propellant apparatus from behind;

wherein each propellant cylinder is pivotal about a single pivot axis thereof alone; and the propellant apparatus is propelled with the pressure receiving face portion thereof being oriented along a pivotal direction of the propellant cylinder about the pivot axis.

With the above construction, as the pivotal cylinder is pivotal about a single pivot axis thereof alone, the flexing direction of the propellant apparatus is allowed only in the direction about the pivot axis, thus inhibiting any flexion of the apparatus during the propelling movement in any other direction. Thus, the steering control scheme of the apparatus may be simple.

Further, as the apparatus is propelled with the pressure receiving face portion thereof being oriented along the pivotal direction of the propellant cylinder, the earth pressure received by the pressure receiving face portion may be utilized efficiently for flexing the propellant apparatus. That is to say, without any complicated steering control, the apparatus may be flexed and propelled efficiently and precisely along a planned path.

According to a further aspect of the present invention, an underground propelling method comprises the steps of:

using a propellant apparatus including a propellant head having a pressure receiving face portion inclined relative to an axis of the head and a plurality of propellant cylinders flexibly and pivotally connected in series to a rear end of the propellant head; and propelling the propellant apparatus under the ground by applying a thrust to the propellant apparatus from behind;

wherein each propellant cylinder is pivotal about a single pivot axis thereof alone; and in a curved path, the propellant apparatus is propelled with the pressure receiving face portion thereof being oriented along a pivotal direction of the propellant cylinder about the pivot axis; and in a straight path, the propellant apparatus is propelled with the pressure receiving face portion thereof being oriented along the pivot axis of the propellant cylinder.

With the above construction, the propellant cylinder is pivotal about a single pivot axis thereof alone, and in a curved path, the apparatus is propelled with the pressure receiving face portion thereof being oriented along a pivotal direction of the propellant cylinder about the pivot axis, thus, unlike the conventional method, the apparatus will be prevented from being propelled in an unexpected direction. Also, the propellant apparatus is flexed, due to the reaction force applied to the pressure receiving face portion from the ground, to the opposite direction to the orientation of the pressure receiving face portion and about the pivot axis, so that the apparatus may be propelled along the planned path.

And, in a straight path, the propellant apparatus is propelled with the pressure receiving face portion thereof being oriented along the pivot axis of the propellant cylinder. Thus, the reaction force from the ground applied to the pressure receiving face portion extends along a plane including the pivot axis. Hence, when the reaction force from the ground is applied to the pressure receiving face portion, this reaction force will not flex or pivot the propellant apparatus about the pivot axis, so that the apparatus may be propelled more straight.

As a result, the deviation of the propelling direction from the planned path will hardly occur, and there arises no necessity of steering control for correcting such deviation, and the apparatus may be propelled with higher precision and efficiency.

According to one preferred embodiment of the invention, the propellant head includes a leader portion which is pivotal relative to the body of the propellant head; and when the propellant head comes into contact with an underground obstacle during the propellant movement, the leader portion is pivoted in such a manner as to substantially register the pivot axis with the orientation of the pressure receiving face portion in the direction of the head axis.

With the above construction, like the foregoing constructions, the propellant apparatus is flexed or pivoted only in the direction along the single pivot axis, not in any other direction like the conventional art. In addition, when the propellant head comes into contact with an obstacle during the propellant movement, the leader portion is pivoted in such a manner as to substantially register the pivot axis with the orientation of the pressure receiving face portion in the direction of the head axis. Therefore, the reaction force from the ground applied to the pressure receiving face portion extends along a plane including the pivot axis. Hence, when the reaction force from the ground is applied to the pressure receiving face portion, this reaction force will not flex or pivot the propellant apparatus about the pivot axis, so that the propellant force may be applied against the obstacle more efficiently. As a result, the obstacle will be pushed away and the apparatus may be propelled straight on. Thus, in comparison with the case of detouring the obstacle, the efficiency of the propelling movement may be improved.

According to a further embodiment, the propellant head includes a leader portion which is pivotal relative to the body of the propellant head; and when the propellant head comes into contact with an underground obstacle during the propellant movement, the leader portion is pivoted in such a manner as to substantially register the pivot axis with the orientation of the pressure receiving face portion in the direction of the head axis; and when the obstacle cannot be pushed away, the apparatus is detoured with pivoting the leader portion about the head axis in such a manner as to cause the pivot axis and the orientation of the pressure receiving face portion to extend transversely as viewed from the direction of the head axis.

With the above construction, when the underground obstacle can be pushed away by the propellant apparatus, the apparatus is further propelled straight on without detouring. On the other hand, when the obstacle cannot be pushed away, the apparatus is detoured with pivoting the leader portion about the head axis in such a manner as to cause the pivot axis and the orientation of the pressure receiving face portion to extend transversely as viewed from the direction of the head axis. Then, the reaction force from the ground applied to the pressure receiving face portion causes the apparatus to flex to detour the obstacle. Then, it is possible to prevent the pivot axis of the apparatus from being subjected to an excessive load, which would be applied to the axis if the apparatus were forcefully propelled against the underground obstacle. Accordingly, the propellant apparatus may be protected against damage effectively.

According to a still further aspect of the present invention, an underground propelling method comprises the steps of:

using a propellant apparatus including a propellant head having a pressure receiving face portion inclined relative to an axis of the head and a plurality of propellant cylinders flexibly and pivotally connected in series to a read end of the propellant head; and propelling the propellant apparatus under the ground by applying a thrust to the propellant apparatus from behind;

wherein the propellant apparatus is propelled into the ground through a pit mouth of a pit-mouth support member disposed adjacent a ground portion to be dug; and in an initial propellant stroke for propelling the propellant apparatus into and through the pit mouth, the apparatus is propelled with setting the orientation of the pressure receiving face portion to cause the propellant apparatus to be flexed to an opposite side to the side of a planned path, and in a subsequent propellant stroke, the apparatus is propelled with setting the orientation of the pressure receiving face portion to cause the propellant apparatus to be flexed to the side of the planned path.

With the above construction, in the initial propellant stage when the propellant apparatus tends to be flexed toward the side of the planned path, the apparatus may be flexed to the opposite side, and thereafter, in the subsequent propellant stage, with resetting of the orientation of the pressure receiving face portion, the propellant apparatus is flexed and propelled to the side of the planned path, thereby correcting the inclination of the propellant apparatus, so that the apparatus may be flexed and propelled smoothly and efficiently with restricting significant sliding friction occurring between the propellant apparatus and the pit-mouth support member.

As a result, the efficiency of the propellant movement may be improved, and also the damage and friction to the propellant apparatus may be restricted, thus extending the life of the propellant apparatus.

Moreover, as the thrust load to be applied to the propellant apparatus may be reduced, the underground propelling method may be implemented with even a drive device of smaller power. So that, the entire cost of the system may be reduced.

According to a still further embodiment of the present invention, in the method described above, the method further comprises: a lateral propelling step for propelling the propellant head from a first underground point to a second underground point along the surface of the ground; and an ascending propelling step of propelling the propellant head from the second underground point to a predetermined third ground-surface point; and wherein, during the lateral propelling step, vertical steering characteristics of the propellant head relative to the ground conditions are obtained and stored in record; and during the ascending propelling step, the obtained and stored characteristics are utilized for reckoning a propelling path thereby to determine the location of the second point.

With the above construction, the vertical steering characteristics of the propellant head relative to the ground conditions are learned from the actual data of measurement of the position of the propellant head when this head is propelled with fixedly maintaining the orientation of its pressure receiving face portion, rather than from calculated or experimentally obtained data calculated or assumed from the outer appearance of the land or ground surface, and based on these actual data, the vertical steering characteristics of the propellant head suitable for the particular ground conditions may be determined. Therefore, there occurs less deviation from the actual conditions and the reckoning of the propelling path in the ascending step, so that the location of the second point may be determined with higher precision. Consequently, the propellant head will reach the target location (i.e. the third ground-surface point) with less deviation therefrom.

According to a still further aspect of the present invention, there is proposed a method of installing an underground pipe utilizing the underground propelling method described above, the method comprising the step of: propelling an elongate propellant apparatus under the ground to cause it reach a surface target point; and drawing an pipe to be installed into an underground hole formed by the underground propelling operation; wherein, prior to the underground propelling operation, an outer sheath is fitted on the pipe, and when the propellant apparatus reaches the target point, the pipe and the outer sheath are together connected with a leading end of this propellant apparatus; then, the pipe and the outer sheath fitted thereon are together drawn into the underground hole as the propellant apparatus is reversely drawn through the underground hole.

With the above, the prior to the underground propelling operation, an outer sheath is fitted on the pipe, and when the propellant apparatus reaches the target point, the pipe and the outer sheath are together connected with a leading end of this propellant apparatus; then, the pipe and the outer sheath fitted thereon are together drawn into the underground hole as the propellant apparatus is reversely drawn through the underground hole. Therefore, the sheath pipe and the pipe are together drawn into the underground hole. Then, there is no necessity of using a sheath pipe of a larger diameter, with taking into consideration some excess cross sectional area needed for allowing installation of the pipe. Also, in association with this, there is no necessity also of using a propellant apparatus of a large diameter. Accordingly, the underground propelling and installing operation may be carried out efficiently. Moreover, when the pipe is drawn into the underground hole, this pipe is covered with the sheath pipe, direct contact between the outer periphery of the pipe and the earth can be avoided, thus the pipe may be protected from frictional damage.

Also, as the pipe and the sheath pipe are together drawn into the underground hole as being together connected with the leading end of the propellant apparatus having reached the target surface point, this drawing force may be applied uniformly to the pipe and the sheath pipe, thus preventing either one of them being subjected to an excessive force to be damaged thereby. Furthermore, the two pipes may be drawn into the ground hole with one step operation. Then, in comparison with two step operations consisting of sheath drawing step and pipe drawing step, the trouble and time needed for the installation may be advantageously reduced.

Consequently, with the pipe installing method described above, the pipe may be installed with being effectively protected against damage, and the propelling operation for forming the underground hole and the pipe drawing operation for drawing the pipe into the underground hole may be effected efficiently and speedily. Then, the efficiency of the entire pipe installing process may be improved.

According to a still further embodiment of the present invention the propellant head includes a transmitter coil and a receiver device is installed in advance at the target ground-surface point for the propellant head; and as the transmitter coil of the propellant head transmits an electromagnet wave and this wave is received by a receiver coil of the receiver device, a deviation amount of the apparatus is reckoned to control the steering direction of the propellant head.

Preferably, in the above construction, the steering control receiver device includes a pair of receiver coils and there is provided a fixing frame for fixedly attaching these receiver coils with axes of the coils being oriented in a same direction, and there is also provided a fixing-frame stand capable of fixing the fixing frame with a desired variable depression angle formed between the axes of the pair of receiver coils and a horizontal plane.

With the above construction, the pair of receiver coils are connected together side by side by the fixing frame, and also the depression angle formed between the pair of receiver coils and the horizontal plane is variable and this angle may be set as desired. Thus, prior to the start of the propelling operation, the right-to-left positioning operation of the receiver device relative to the planned propellant path and the setting of the depression angle for obtaining a maximum reception sensitivity may be effected readily at one time for both of the pair of receiver coils. Moreover, during the propelling operation too, the position of the receiver device may be readily adjusted so as to maintain good reception. As a result, the precision and the efficiency of the steering control may be further improved.

Further, there is further provided depression-angle adjusting means for automatically adjusting the depression angle formed between the pair of receiver coils and the horizontal plane so as to obtain maximum signal intensity for the pair of receiver coils.

With the above, as the good reception sensitivity during the propelling operation may be automatically obtained, the precision and efficiency of the steering control may be still further improved.

Consequently, with use of the receiver device having the above-described construction, the amount of work needed for installing the steering control receiver device at the target ground-surface point and the amount of work needed for changing the installed position of the device may be significantly reduced. At the same time, the intensity of the electromagnetic signals received by the pair of receiver coils may always be maintained at the optimal level. Then, the precision of the steering control of the propellant apparatus based the electromagnetic wave intensity may be significantly improved.

Further and other objects, features and effects of the invention will become more apparent from the following more detailed description of the embodiments of the invention with reference to the accompanying drawings.

DESCRIPTION OF THE PREFERRED EMBODIMENTS

Preferred embodiments of an underground propelling method relating to the present invention will be described in details with reference to the accompanying drawings.

Figure 1:
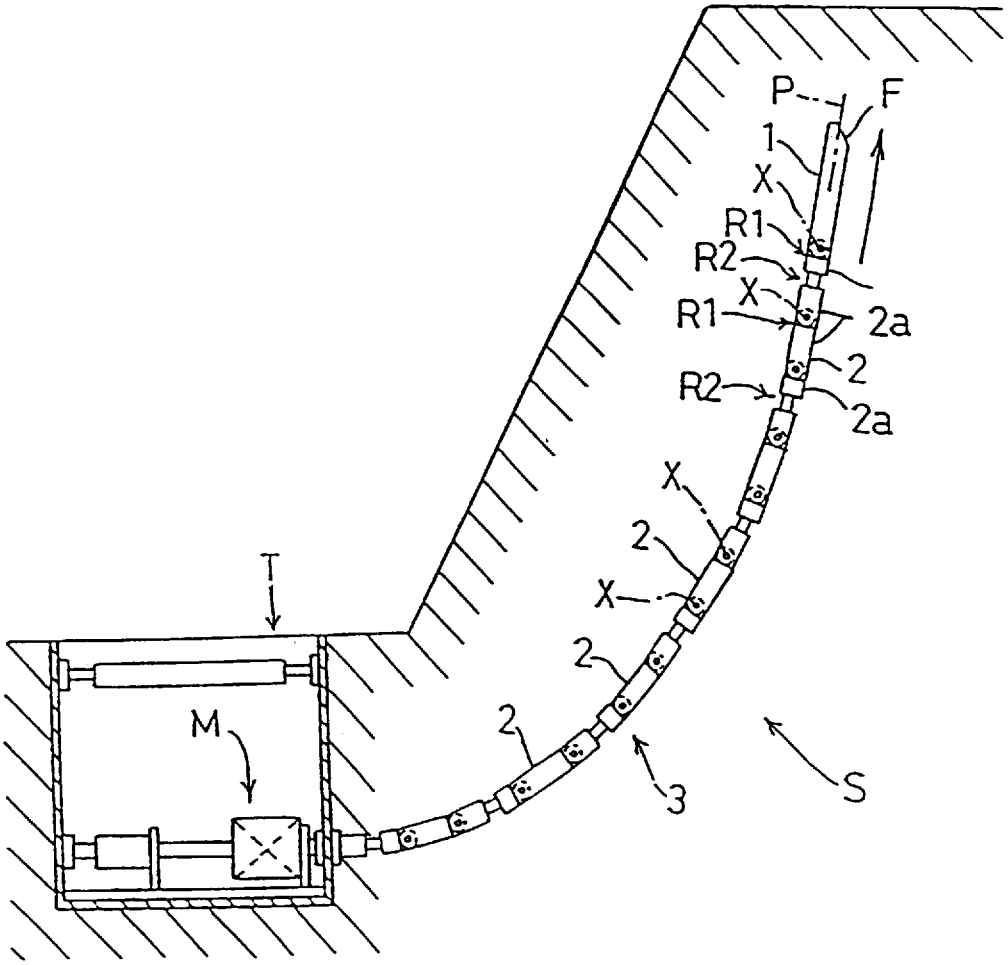
FIG. 1 is a side view showing a propelling condition in an embodiment of the present invention.
Figure 2:
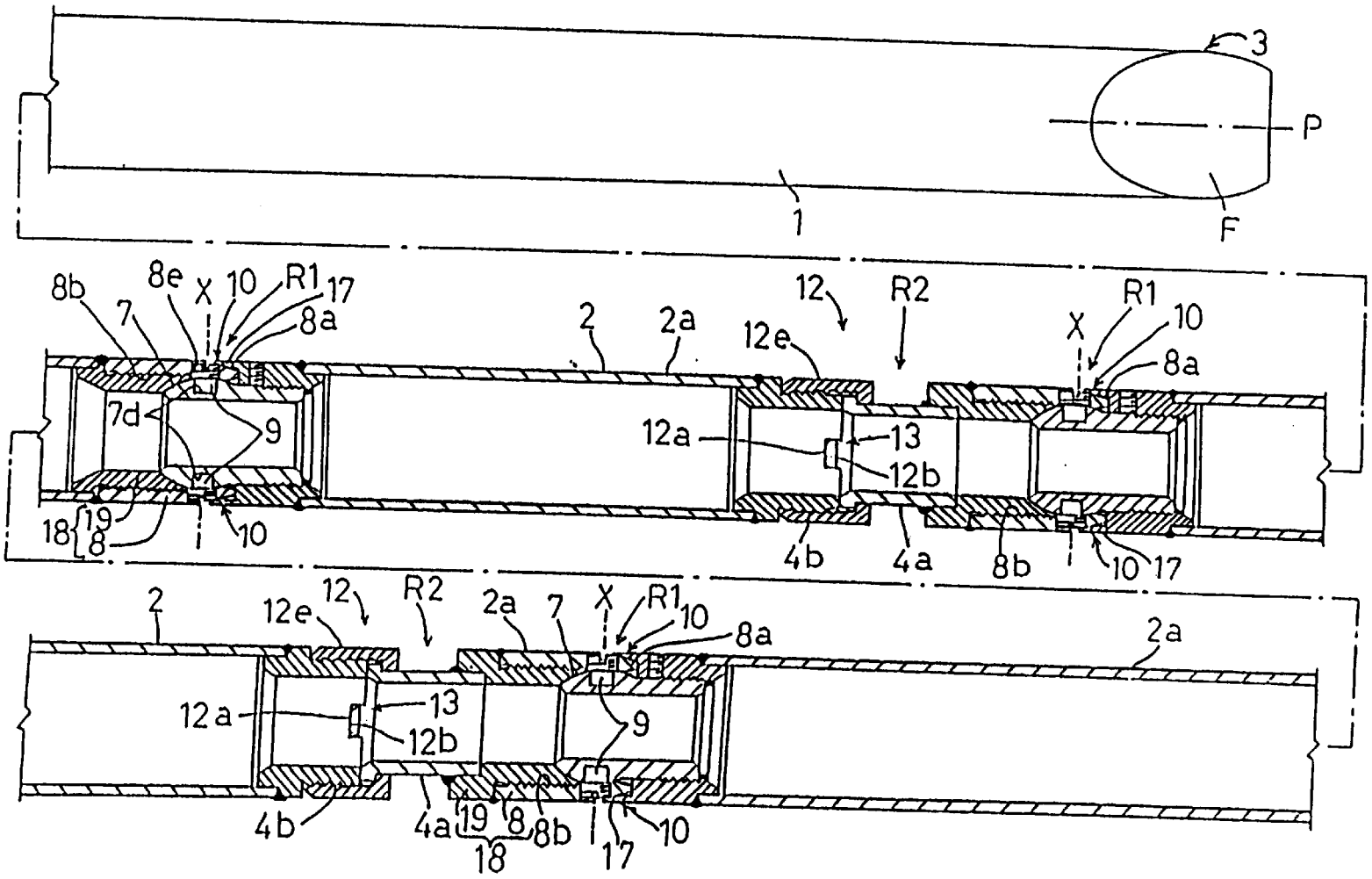
FIG. 2 is a bottom view in section showing principal portions of a propellant apparatus shown also in FIG. 1.
Figure 3:
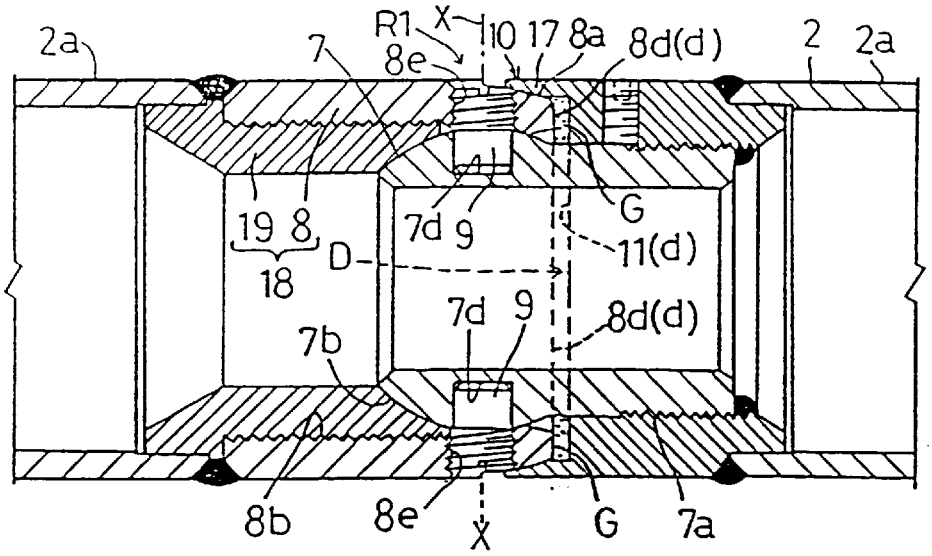
FIG. 3 is a detailed view in vertical section of a flexible connecting portion of the propellant apparatus in FIG. 1.

As shown in FIGS. 1 and 2 (showing serially interconnected condition of a plurality of propellant cylinders), a propellant apparatus S for use in this underground propelling method includes a propellant head 1 having a substantially cylindrical outer configuration and a propellant apparatus body 3 having a plurality of propellant cylinders 2 serially interconnected with a rear end of the propellant head 1. The apparatus body 3 includes a plurality of flexible connecting portions R1 and a plurality of inflexible connecting portions R2 with longitudinal distances therebetween.

As shown in FIG. 2, the propellant head is formed of a metal cylindrical member, and integrally includes, at a closed leading end thereof, a pressure receiving face portion F inclined relative to a head axis P. As the pressure receiving face portion F receives earth pressure in association with a propelling movement of the apparatus, the propellant head 1 is guided to a side opposite to the side to which the pressure receiving face portion F is oriented. The propellant head 1 includes, at an intermediate portion thereof, one of the flexible connecting portions R1. And, this flexible connecting portion R1 is pivotally flexible only about a transverse axis (an example of flexion pivot axis) extending along the radial direction of the apparatus body 3. The pressure receiving face portion F is formed in a direction perpendicular to the transverse axis X.

At the base end of the propellant head 1, one split portion 4*a* of the inflexible connecting portion R2.

Each propellant cylinder 2 is formed of a metal cylinder having a small diameter of 50 mm approximately. And, at the leading end of the cylinder 2 (i.e. the forward end in the propelling direction), the other split portion 4*b* of the inflexible connecting portion R2 which is detachable connectable with the split portion 4*a*. Further, at the base end (the rear end in the propelling direction) of the propellant cylinder 2, the one split portion 4*a* is provided, like the propellant head 1. The one split portion 4*a* and the other split portion 4*b* when connected with each other together constitute the connected inflexible connecting portion R2.

At intermediate portions of the propellant cylinder 2, as shown in FIG. 2, two flexible connecting portions R1 are provided respectively. Accordingly, the propellant cylinder 2 essentially consists of the opposed split portions 4*a*, 4*b* provided at the opposed ends, three cylinder portions 2*a* and of the two flexible connecting portions R1 formed between the adjacent cylinder portions 2*a*.

The flexible connecting portion R1 will be described in greater details next. As shown in FIGS. 2 through 8, at an end (forward end) of one cylinder portion 2*a*, there is formed a spherical face engaging portion 18 having a cylindrical shape, and at the end (rear end) of the other cylinder portion 2*a*, there is formed a spherical engaging portion 7 which is engageable into the spherical face engaging portion 18, and the two mating engaging portions 7, 18 are engaged with each other.

The spherical face engaging portion 18 includes a cylindrical member (an example of first cover cylindrical portion) 8 having a tapered top and a connecting cylinder portion 19 to be connected with the one cylinder portion 2*a*. The inner peripheral faces at the one ends (forward ends) respectively of the cylindrical member 8 and the connecting cylindrical portion 19 are formed as concave faces extending along the outer peripheral face of the spherical engaging portion 7. The outer peripheral face at the recess portion of the cylindrical member 8 is formed as a convex curved face (spherical face) extending about the flexion pivot axis between the adjacent propellant cylinders 2. This convex curved portion will be referred to as a curved face portion 8*a* (see FIG. 5). And, the end face portion at the recess (forward end) is formed as a planar portion 8*d* having two planes. Incidentally, the cylindrical member 8 is constructed so as to cover the flexible connecting portion R1 in cooperation with a sliding contact cylindrical member 17 to be described later.

On the other hand, the spherical face engaging portion 7 includes, at an end thereof, a male thread portion 7*a* threadable into the propellant cylinder portion 2*a* and includes, at the other end a spherical portion 7*b* extending along the inner peripheral face at the one end (forward end) of the spherical face engaging portion 18.

Figure 6A:
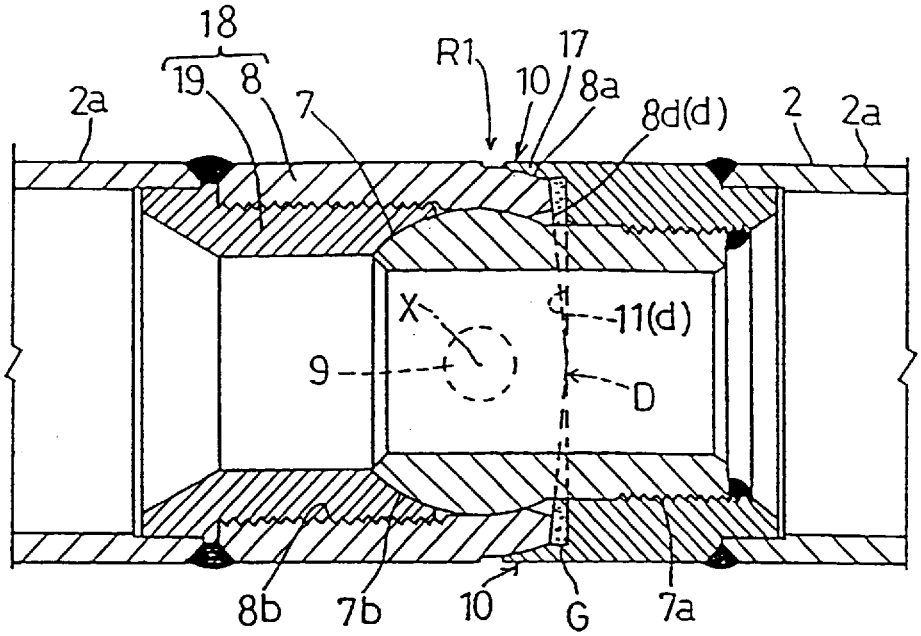
Figure 6B:
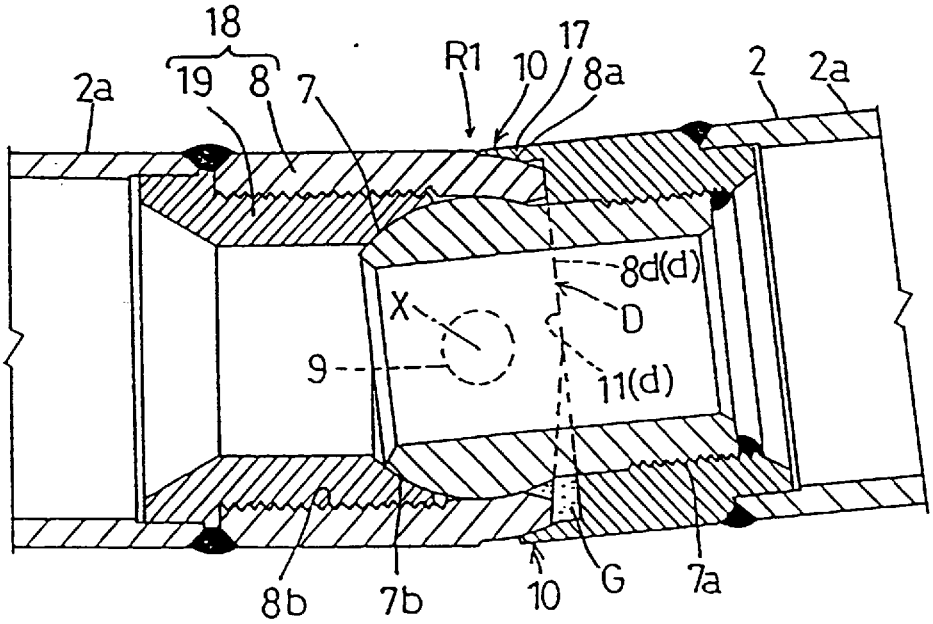
Figure 7:
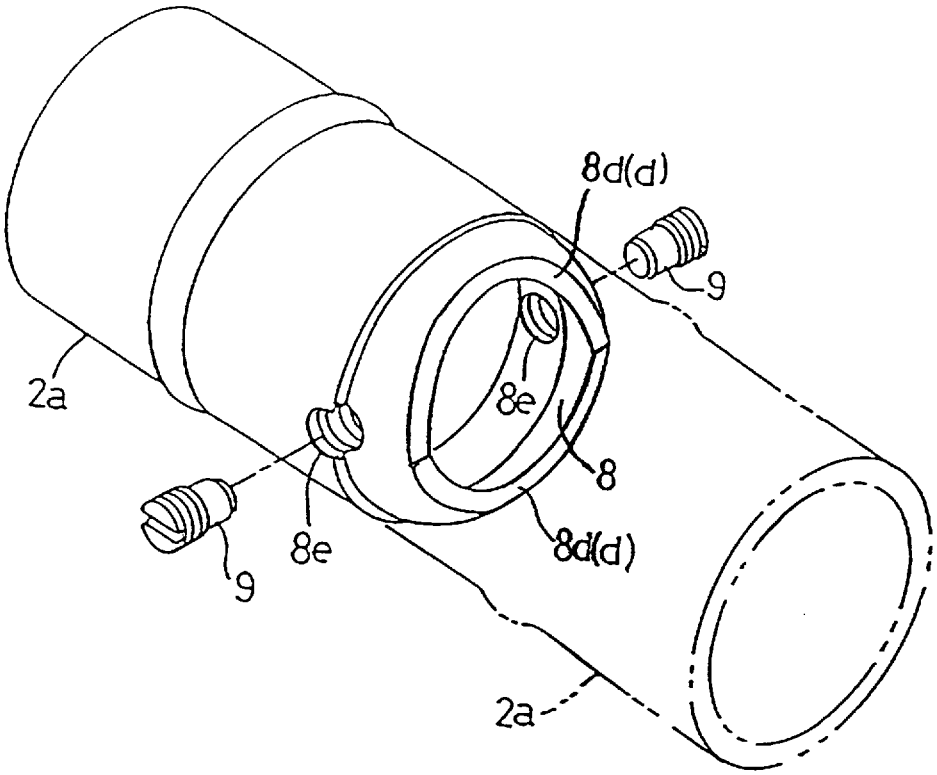
FIG. 7 is an exploded perspective view of the flexible connecting portion of FIG. 6.
Figure 8:
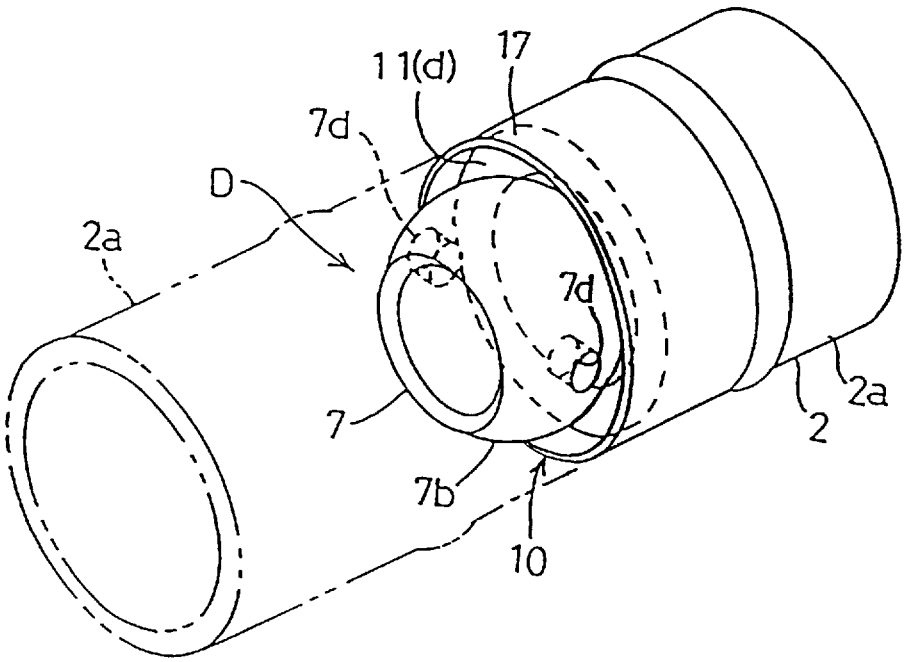
FIG. 8 is an exploded perspective view of the flexible connecting portion of FIG. 6.

The spherical engaging portion 7 and the spherical face engaging portion 18, as engaged with each other, are connected by two pins 9 to be pivotally flexible about the transverse axis X. Incidentally, one ends of the pin 9 are inserted almost gaplessly into recesses 7*d* formed at portions (mutually opposed portions) in the outer face of the spherical engaging portion 7 and having a depth thereof extending along the transverse axis P, and the other ends of the pins 9 are threaded into through threaded holes 8*e* formed at portions of the spherical face engaging portion 18 (two positions corresponding to the recesses 7*d*), the through holes 8*e* being formed along the transverse axis X. With the engagement by the insertion of the opposed ends of the pins 9, the flexible connecting portion R1 is pivotally flexible about the transverse axis X as illustrated in FIGS. 6(*a*), (*b*). Incidentally, the two flexible connecting portions R1 formed in each single propellant cylinder 2 have the respective transverse axes X thereof extending substantially parallel or parallel with each other.

At the end (rear end) of the one cylinder portion 2*a* to which the spherical engaging portion 7 is threaded, there is provided the sliding contact cylindrical member 17.

Figure 5:
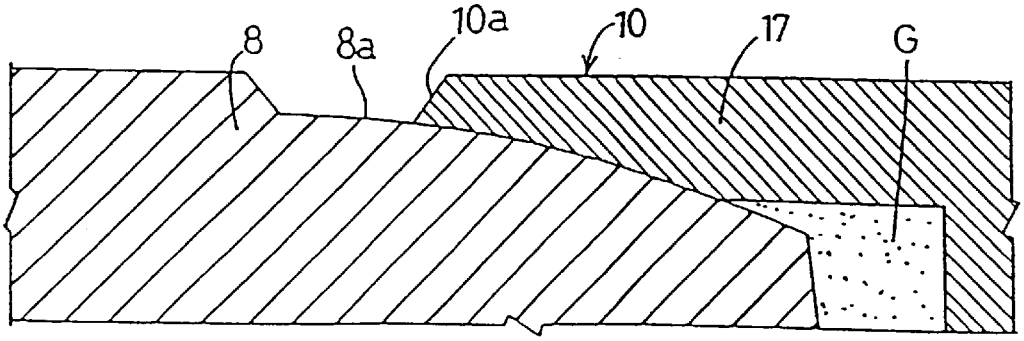
FIG. 5 is a section view of a sliding portion of the propellant apparatus of FIG. 1, FIGS. 6(*a*), (*b*) are views illustrating functions of the flexible connecting portion shown in FIG. 3.

At the inner peripheral portion at the end (rear end) of the sliding contact cylindrical member 17, there is formed a sliding contact portion 10 which comes into sliding contact with the curved face portion 8*a* as the cylindrical member 8 and the sliding contact cylindrical member 17 are engaged with each other so as to close the gap formed between the two adjacent propellant cylinder portions 2*a*. This sliding contact portion 10 is adapted to come into face contact with the curved face portion 8*a*. On the other hand, the outer peripheral portion at the end (rear end) of the sliding contact cylindrical member 17 is has a tapered shape as shown in FIG. 5. With provision of this tapered portion 10*a*, in association with pivotal flexion of the flexible connecting portion R1, the adjacent earth can be guided to the outer side of the cylinder along its tapered inclination, thus restricting intrusion of the earth into the flexible connecting portion R1.

The end face portion (located on the inner side of the sliding contact portion 10) of this propellant cylinder portion 2*a* is formed as a flat face, so that in association with flexion about the transverse axis X, either one of the two flat face portions 8*d* formed at the leading end of the spherical face engaging portion 18 comes into face contact thus limiting the maximum angle of flexion between the adjacent propellant cylinder portions 2*a*. The flat face portions 8*d* and the end face portion 11 together constitute angle restricting opposed portions (d). The opposing angle of these angle restricting opposed portions (d) is set along the longitudinal direction of the propellant cylinder portion 2*a*.

Accordingly, a propelling force, under the angle restricted condition, is transmitted to the both propellant cylinder portions 2*a* via a compression force in the longitudinal direction. Thus, in comparison with a bending force or shearing force, the above construction can transmits the force more efficiently.

Incidentally, the flat face portions 8*d* and the end faces portions 11 will generically referred to as angle restricting means D hereinafter.

On the other hand, at the gaps formed between the spherical engaging portion 7, the flat face portions 8*d* and the end face portion 11, grease G is charged, so as to prevent intrusion of earth or underground water or the like into the propellant cylinder 2 from the outside of the flexible connecting portion R1 via the gaps between the adjacent propellant cylinder portions 2*a* and also to reduce friction generated in association with the flexion.

Figure 9:
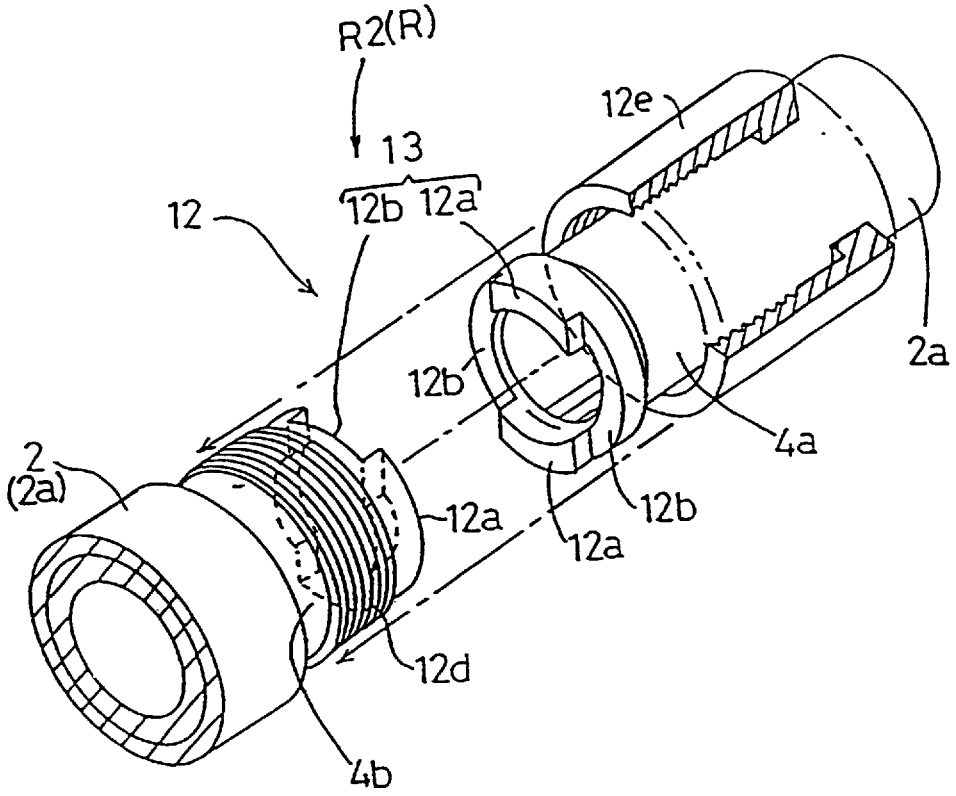
FIG. 9 is an exploded perspective view showing an registering-integrating portion of the propellant apparatus of FIG. 1.

The inflexible connecting portion R2 will be described in greater details next. As shown in FIG. 9, this portion is detachably connectable by means of a registering-integrating portion 12, so that this inflexible connecting portion R2 may be separated into two when necessary (e.g. when the propellant apparatus body 3 should be stored as compactly as possible). This registering-integrating portion 12 includes a convex portion 12*a* formed in the one split portion 4*a* and a concave portion 12*b* formed in the other split portion 4*b*. Then, the convex portion 12*a* and the concave portion 12*b* are registered with each other as a female thread portion (formed in the one split portion 4*a*) 12*e* is fixedly threaded with a male thread portion (formed on the other split portion 4*b*), so that the two portions are disconnectably connected with each other. Further, the convex portion 12*a* and the concave portion 12*b* are formed in such a manner that these portions 12*a*, 12*b* can be registered with each other with 180 degree phase displacement about the pivot axis of the propellant cylinder. Accordingly, the transverse axes of the propellant cylinders 2 interconnected with each other via the inflexible connecting portion R2 extend parallel with each other. The convex portion 12*a* and the concave portion 12*b* together constitute a registering mechanism 13.

Referring to a propelling method of this embodiment using the propellant apparatus S having the above-described construction, as illustrated in FIG. 1, a pit T is formed in advance at a predetermined start position and a thrust device M is disposed within this pit T. Then, the thrust device M is driven to propel the propellant apparatus S from the pit T into the earth in a predetermined direction (an oblique upward direction in the instant embodiment). In the above, in the initial setting of the propellant apparatus S, the propellant head 1 is set so that its pressure receiving face portion F is oriented downward and then the propellant cylinders 2 are connected with this propellant head via the inflexible connecting portions R2. With these, the flexion pivot axes of the respective flexible connecting portions R1 of the propellant apparatus S are oriented laterally. Then, as the apparatus S is propelled into the earth by the thrust device M, the propellant apparatus S will be propelled obliquely upward in a speedy and smooth manner.

[OTHER EMBODIMENTS]

Next, other embodiments of the invention will be specifically described.

Figure 10:
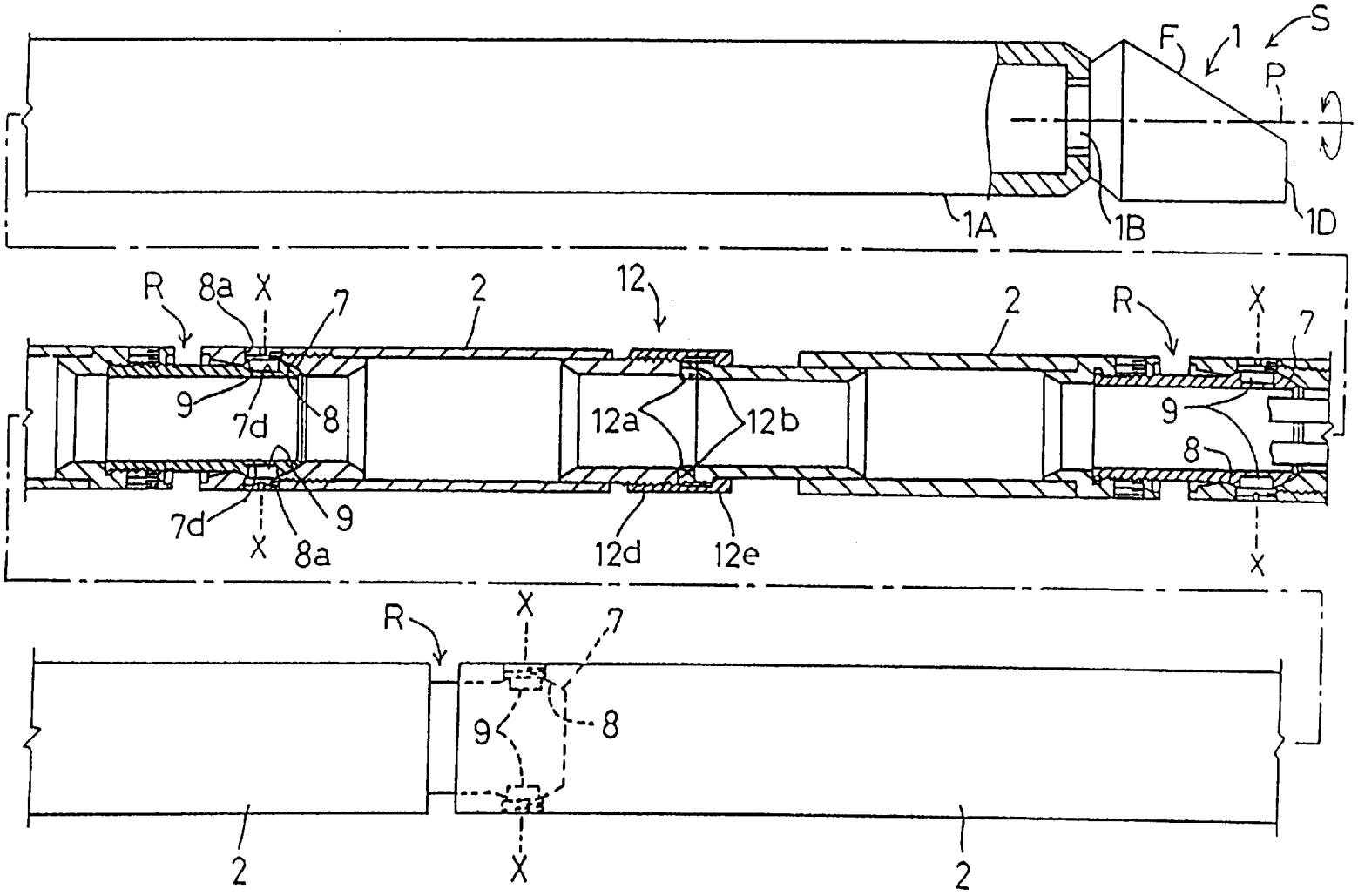
FIG. 10 is a bottom view in section showing principal portions of a propellant apparatus according to a further embodiment of the invention.
Figure 11:
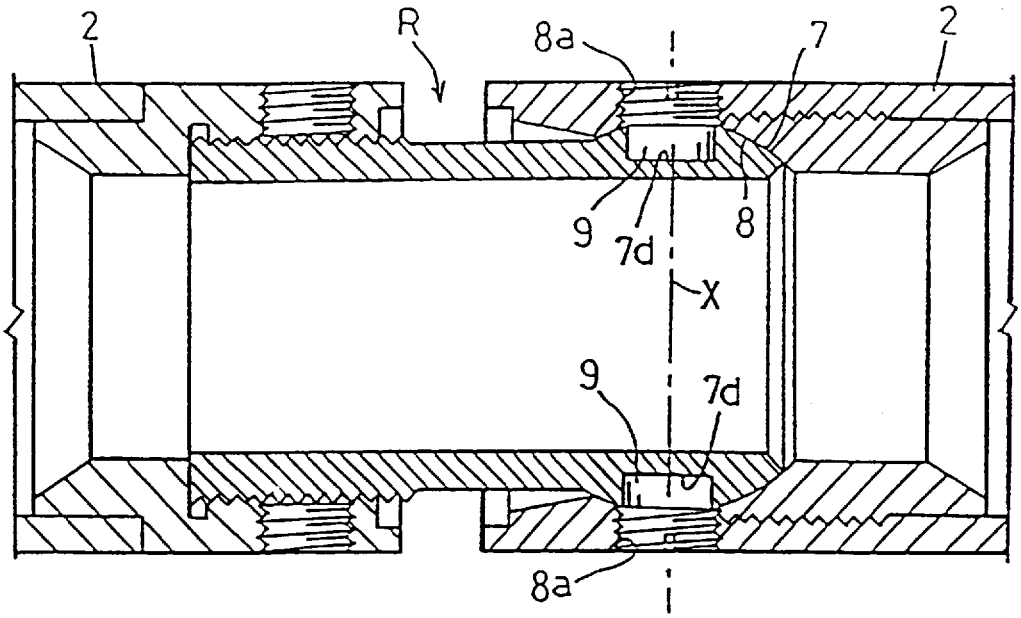
FIG. 11 is a detailed view in vertical section of a connecting portion of the propellant apparatus of FIG. 10.
Figure 12:
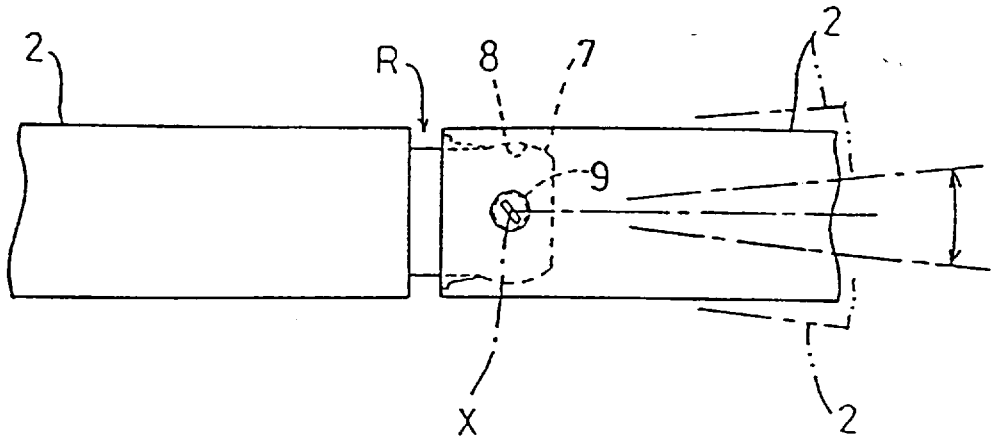
FIG. 12 is a view illustrating function of the connecting portion of FIG. 11.

(1) In this embodiment, as shown in FIGS. 10 through 12, in the propellant apparatus S, a plurality of propellant cylinders 2 having a small bore diameter (e.g. a bore diameter of 100 mm or less) are flexibly connected with each other via connecting portions R each pivotally flexible about a transverse axis (an example of flexion pivot axis) X extending normal to the longitudinal axis of the propellant cylinder 2. And, to the leading end of these interconnected propellant cylinders 2, there is connected a propellant head 1 having a substantially cylindrical outer configuration. Incidentally, in this embodiment, the connecting portion between the propellant head 1 and the propellant cylinder 2 and the further connecting portion between the adjacent propellant cylinders 2 both are comprised of the connecting portions R.

Figure 4:
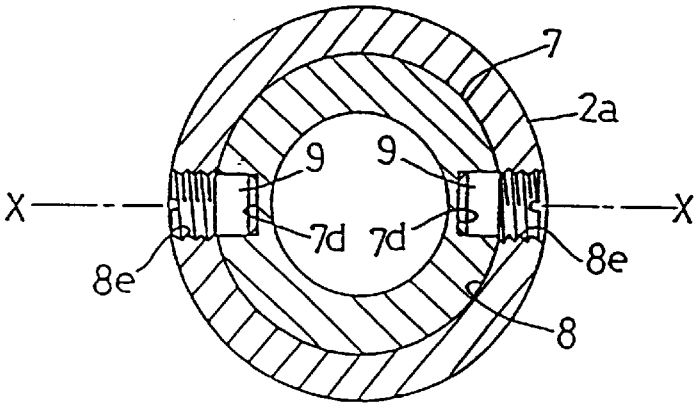
FIG. 4 is a detailed view in horizontal section of the flexible connecting portion (or connecting portion) of the propellant apparatus of FIG. 1.

The connecting portion R will be described in greater details next with reference to FIGS. 10, 11 and 4. A spherical engaging portion 7 provided at the leading end of each propellant cylinder 2 and a spherical face engaging portion 8 provided at the base end of each cylinder 2 are connected to each other by pins 9 to be pivotally flexible about the transverse axis X. Incidentally, one ends of the pins 9 are inserted almost gaplessly into recesses 7*d* formed at portions (mutually opposed portions) in the outer face of the spherical engaging portion 7 and having a depth thereof extending along the transverse axis P, and the other ends of the pins 9 are threaded into through threaded holes 8*e* formed at portions of the spherical face engaging portion 8 (two positions corresponding to the recesses 7*d*), the through holes 8*e* being formed along the transverse axis X. With the engagement by the insertion of the opposed ends of the pins 9, the connecting portion R is pivotally flexible about the transverse axis X as illustrated in FIG. 12.

Incidentally, by varying the diameter of the one end of the pin 9 so as to allow this end of the pin 9 to be inserted into the recess 7*d* with a sufficient gap, the connecting portion R will be freely flexible and pivotal to the limit allowed by this gap. That is to say, with exchange of the pins 9 for different ones, it is readily possible to switch over the condition of the connecting portion R from the condition in which the connecting portion is flexible about the transverse axis X to the further condition in which the connecting portion is flexible freely in other directions too.

In some of the propellant cylinders 2 selected from the plurality of propellant cylinders 2, the cylinder is detachably connectable into two via a registering-integrating portion (see FIG. 9) 12, like the one described in the foregoing embodiment.

As shown in FIG. 10, the propellant head 1 includes a cylindrical head body 1A constituting the main body of this head, a drive shaft 1B accommodated inside the head body 1A to be driven to rotate about the axis P of this propellant head (to be referred to as the head axis hereinafter) in association with supply of driving fluid (e.g. operating oil, lubricant or the like), and a leader portion 1D attached to the leading end of the drive shaft 1B.

The leader portion 1D includes a pressure receiving face portion F inclined relative to the head axis P. Then, as the drive shaft 1B is driven to rotate, the leader portion 1D is rotated to an appropriate posture, thus orienting the pressure receiving face portion to an appropriate direction. And, as the pressure receiving face portion F receives pressure from the earth in association with a propelling movement of the apparatus, the propellant cylinder 2 and the propellant head 1 are pivotally flexed about the transverse axis X, whereby the orientation of the propellant head is switched over. In the course of this, if the pressure receiving face portion F is set to the direction along the transverse axis X, then, the earth pressure will be exerted in a direction crossing the axis X. Accordingly, the propellant apparatus S may be propelled more straight without much flexion. Incidentally, the current orientation of the pressure receiving face portion can be detected by an unillustrated sensor incorporated within the propellant head 1. The inclination angle of the pressure receiving face portion 1A may be about 31 degrees, for example. Also, the dimensions of the head body 1A may be e.g. an outer diameter of about 54 mm and a length of about 510 mm. In the case of a simple type head whose leading end is unrotatable, the dimensions of the head body 1A may be e.g. an outer diameter of about 54 mm and a length of 300 mm. Further, the dimension of the propellant cylinder may be e.g. an outer diameter of 54 mm and an distance between the flexible connecting portions of about 300 mm, respectively. However, these dimensions are just some examples and the present invention is not limited to these specific dimensions.

Figure 13:
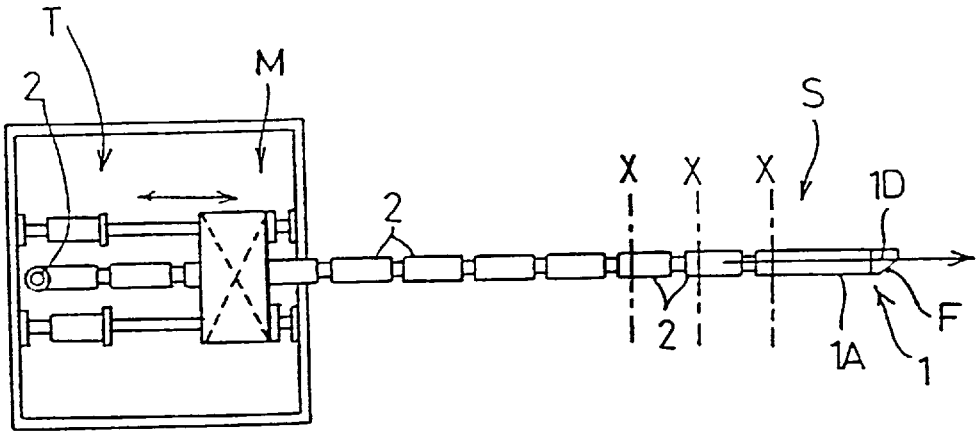
FIG. 13 is a top view showing a straight propelling condition of the propellant apparatus of FIG. 10.
Figure 14:
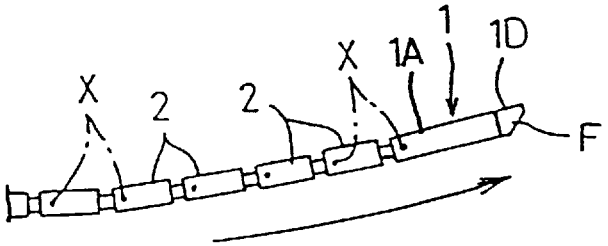
FIG. 14 is a side view showing a curved propelling condition of the propellant apparatus of FIG. 10.
Figure 15:
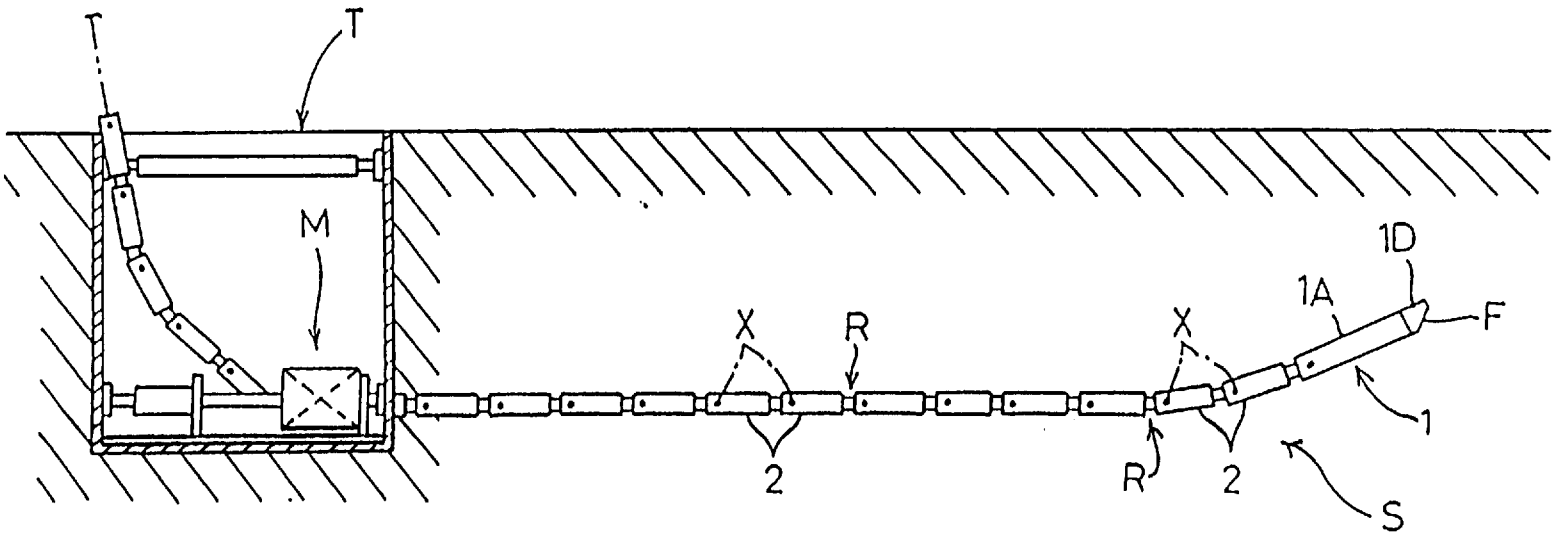
FIG. 15 is a side view showing a propelling condition of the propellant apparatus of FIG. 10, FIGS. 16*a–b* are explanatory views of a propelling method when there is an obstacle.

Referring to a propelling method of this embodiment using the propellant apparatus S having the above-described construction, as illustrated in FIG. 15, a pit T is formed in advance at a predetermined start point, and a thrust device M is disposed inside this pit T. Then, by activating this thrust device M, the propellant apparatus S is propelled into the earth in a predetermined direction. In a curved propelling path, as shown in FIG. 14, the apparatus is propelled with orienting the pressure receiving face portion F in the direction (upward or downward) along the pivotal direction of the propellant cylinder 2 about the transverse axis X. Whereas, in a straight propelling path, as shown in FIG. 13, the apparatus is propelled with orienting the pressure receiving face portion F in the direction along the transverse axis X (i.e. the transverse direction).

Figure 16A:
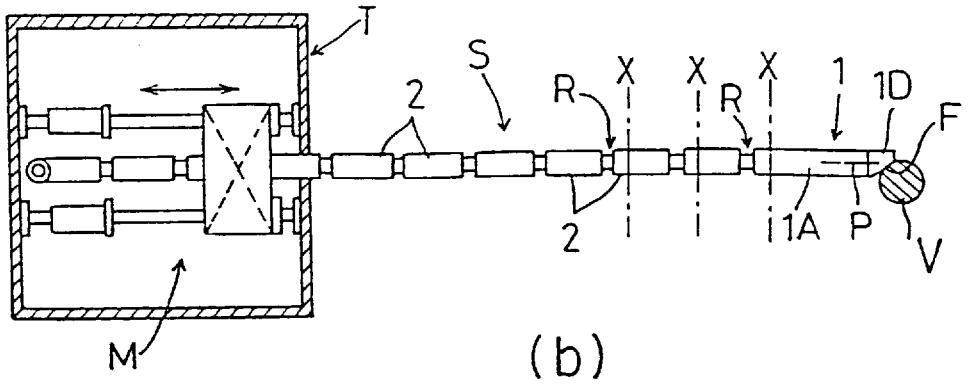
Figure 16A:
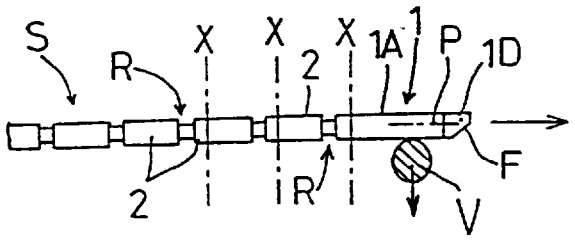

In this propelling method of this embodiment using the propellant apparatus S, when the propellant head 1 comes into contact with an underground obstacle V during the propelling movement, as shown in FIG. 16, the apparatus is propelled with orienting the pressure receiving face portion F in the direction along the transverse axis X so as to push away the obstacle V.

Figure 17:
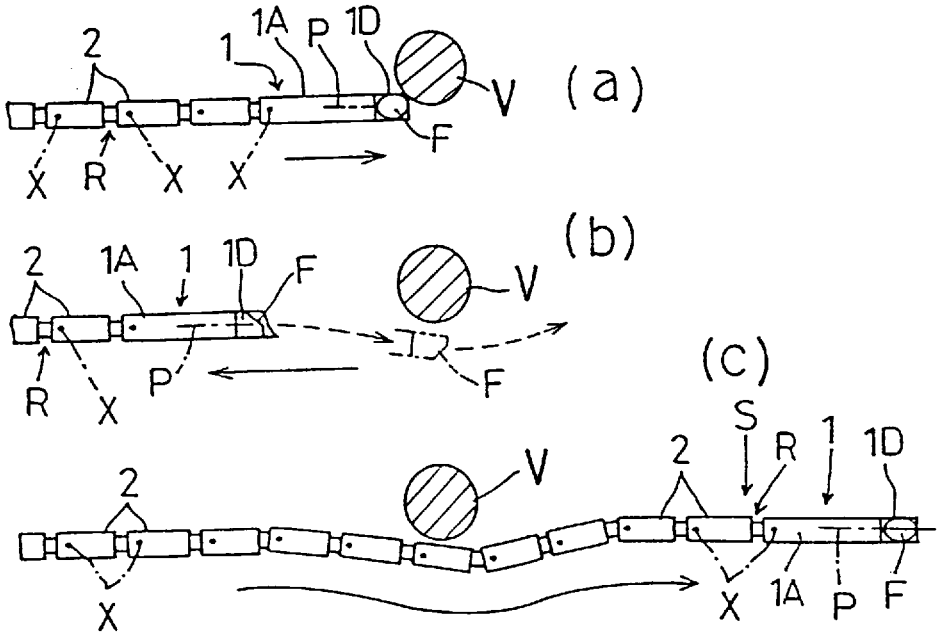
FIGS. 17*a–e* are explanatory views of a propelling method when there is an obstacle.

If the obstacle V cannot be pushed away, as shown in FIG. 17, the propellant apparatus S is temporarily withdrawn by a predetermined distance, and then, the apparatus is caused to make a detour, with orienting the pressure receiving face portion F in the direction (upward or downward) crossing the transverse axis X.

(2) A still further embodiment of the invention will be described next.

Figure 18:
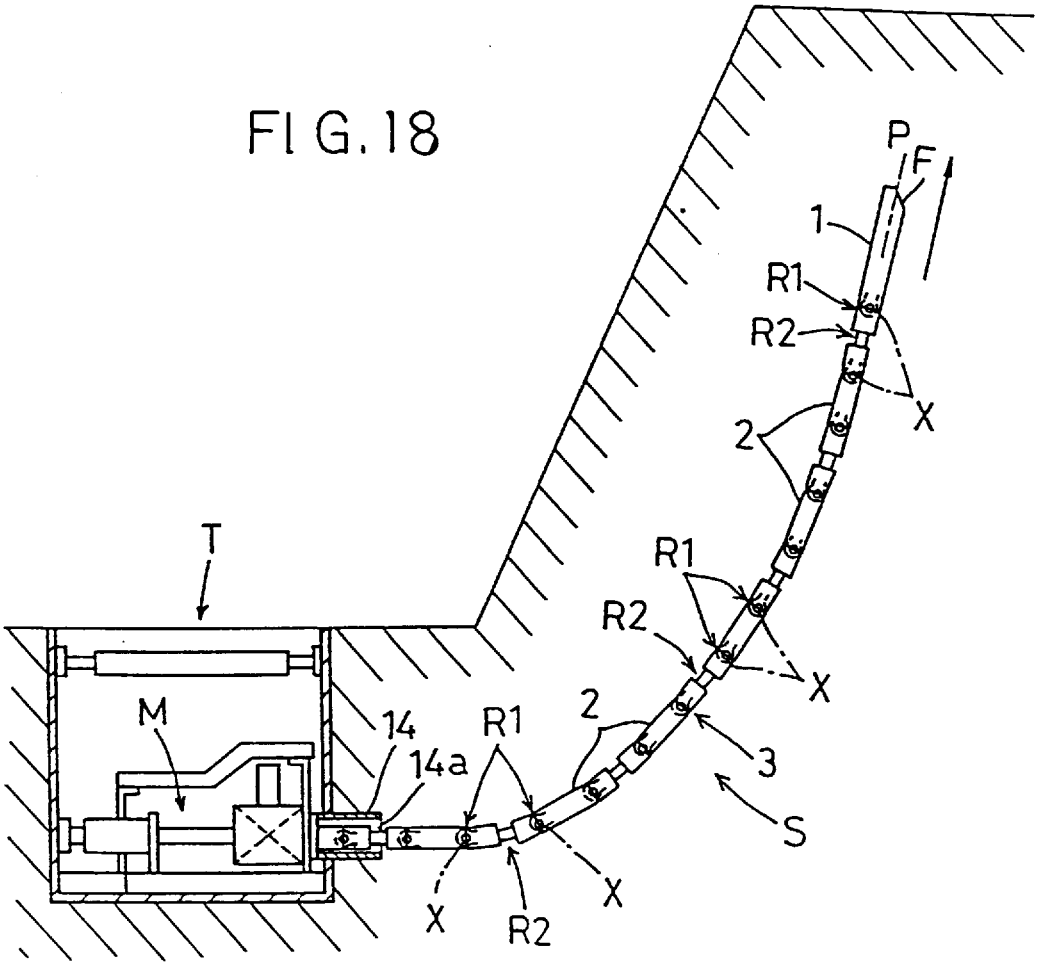
FIG. 18 is a side view showing a propelling condition of a propellant apparatus of a still further embodiment, FIGS. 19(*a*), (*b*) and (*c*) are views illustrating propelling methods of the propellant apparatus of FIG. 18.
Figure 19:
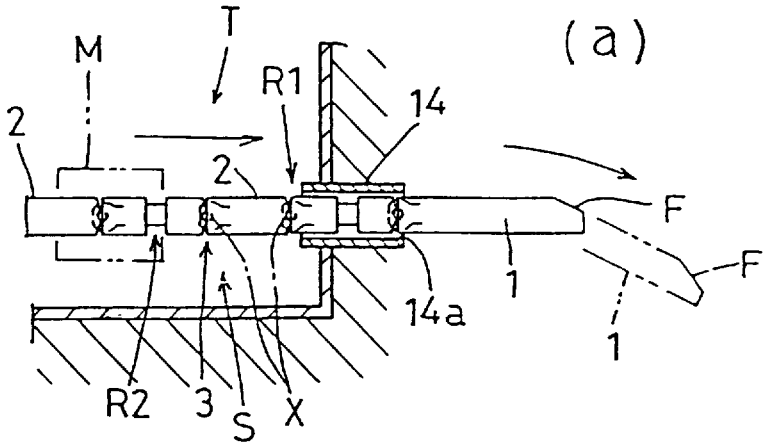
Figure 19:
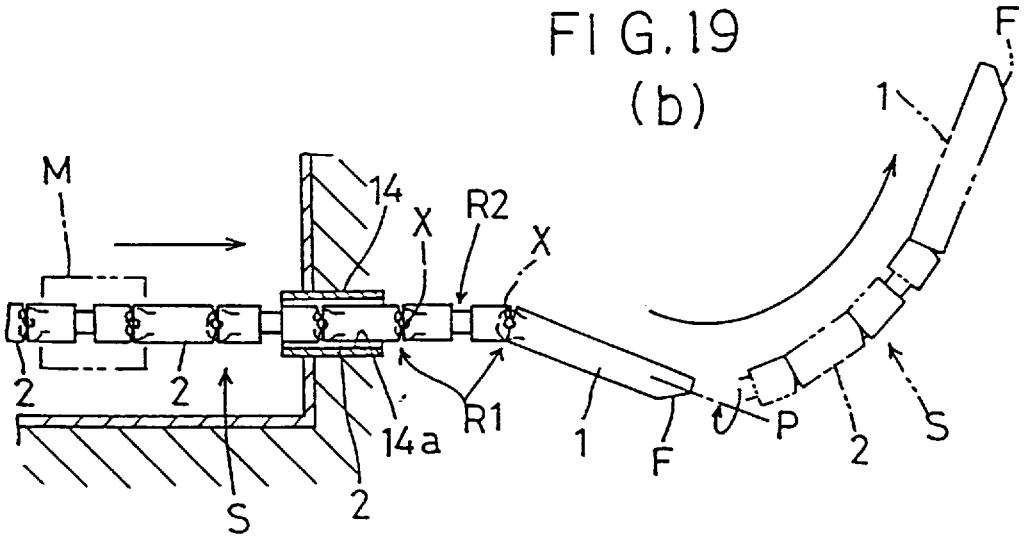
Figure 19:
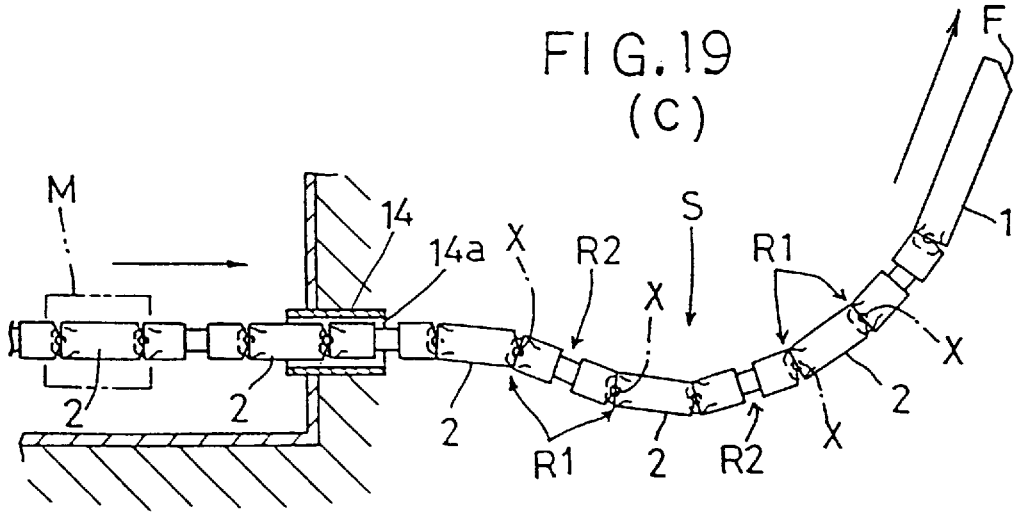

In a propelling method of this embodiment using a propellant apparatus S, as shown in FIGS. 18 and 19, a pit T is formed in advance at a predetermined start point and a thrust device M is disposed within this pit T. Then, the propellant apparatus is propelled by the thrust device M in a planned direction (obliquely upward in this embodiment) into the earth. Further, at a predetermined position in an earth stopping wall of the pit T there is installed in advance a guide pipe (an example of a pit-mouth support member) 14, so that an inner opening of this guide pipe 14 constitutes a pit mouth 14*a*.

Preferring more particularly to the curved propelling method, first, as shown in FIG. 19(*a*), the propellant apparatus S is set so as to orient the pressure receiving face portion upwards. Then, during the initial propelling stroke for propelling the propellant apparatus S into the mouth pit 14*a*, the propellant apparatus S is propelled with maintaining the above-described set condition. As a result, the propellant apparatus S pushed in is inclined downwards as its pressure receiving face portion F receives the earth pressure.

In a subsequent stroke, as shown in FIG. 19(*b*), the apparatus is propelled with orienting the pressure receiving face portion F to cause the apparatus S to be flexed to the planned direction, i.e. orienting the face portion F downwards in this particular embodiment. More particularly, the orientation of the pressure receiving face portion F is adjusted by rotating the apparatus from its base end about the head axis P. Then, when the pivot axes X of the respective flexible connecting portions R1 are oriented laterally, the apparatus is pushed into the earth by the thrust device M, so that the propellant apparatus S is pivotally flexed upward about the transverse axes X and propelled into the earth in this condition. (see FIG. 19(*c*)). In the course of this, as the leading end of the propellant apparatus S receives the upward earth pressure, the inclination of the base end of the propellant apparatus which was inclined downwards during the initial propelling stroke is now corrected, so that the guide pipe 14 and the propellant apparatus S become substantially linearly aligned with each other and therefore the propelling movement can take place with reduced frictional resistance between the pipe 14 and the apparatus S.

Incidentally, the flexion pivot axis is not limited to the transverse axis described in the foregoing embodiments. Instead, if the propelling path comprises a right or left curved path within a horizontal plane, the flexion pivot axis may be a vertical axis.

In the foregoing embodiments, the pressure receiving face portion is formed integral with the propellant head. Alternatively, this portion may be attached to the head body to be rotatable about the head axis P.

(3) A still further embodiment of the invention will be described next.

Figure 20:
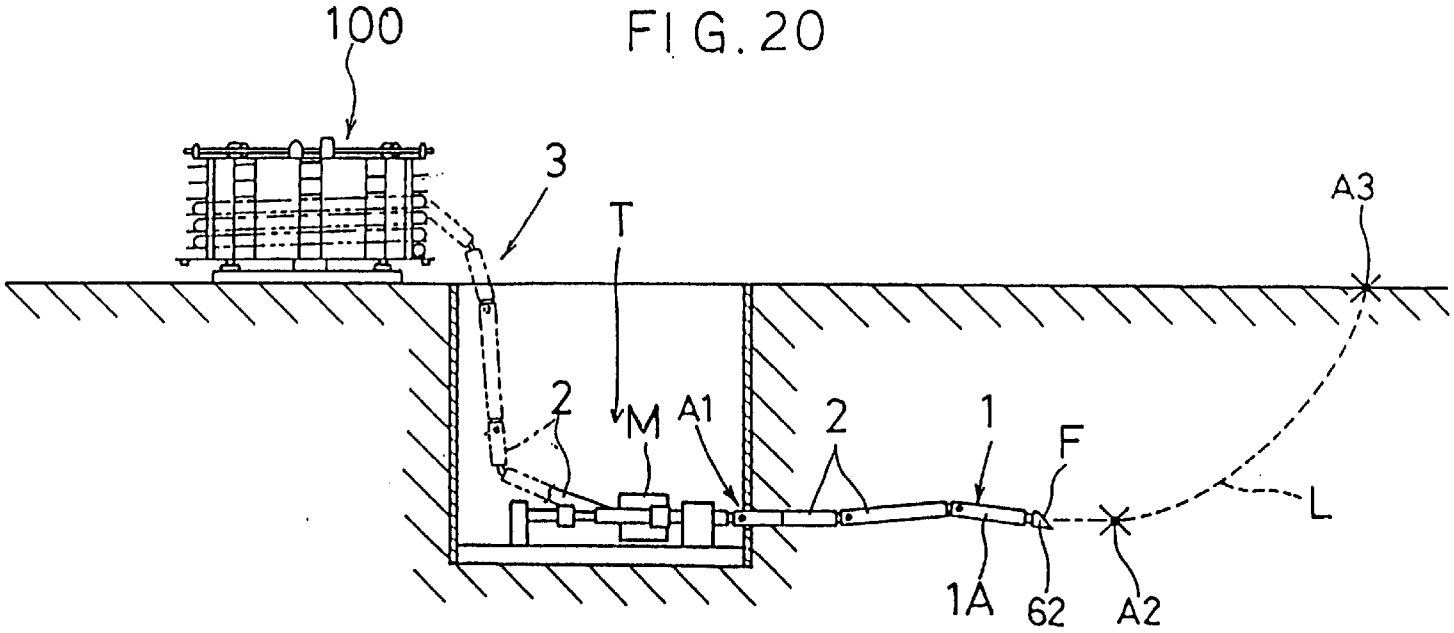
FIG. 20 is a concept view illustrating a propelling method of a propellant apparatus according to a still further embodiment.

FIG. 20 shows an example of a system with which a propelling method relating to this embodiment can be implemented.

In FIG. 20, the propelling system includes a propellant apparatus body 3 includes a plurality of propellant cylinders 2 and a propellant head 1 attached to the leading end of the cylinders 2, a thrust device M, and a propellant cylinder winding mechanism 100.

The thrust device M is disposed on a bottom face of the pit T dug underground. In operation, the thrust device M thrusts the propellant head 1 and the propellant cylinders 2 by means of hydraulic pressure from a point A1 (an example of a first underground point) located at the bottom of a vertical wall face of the pit T, so that the propellant head 1 and the propellant cylinders 2 are pushed into the earth one after another. In the course of this propelling operation, the propelling direction of the propellant head 1 can be controlled by orientation of the pressure receiving face portion F formed with an inclination relative to the head axis P. The propellant head 1 includes a head body 1A connected with the first propellant cylinder 2 to be pivotable about one pivot axis and a rotary portion 62 formed integral with the pressure receiving face portion F. By remote control, the rotary portion 62 may be rotated about an axis extending along the longitudinal axis of the head body 1A. Then, as the head 1 is pushed from behind with the pressure receiving face portion F being oriented upwards, this propellant head 1 is propelled downward; and when the orientation of the face portion F is switched over to the downward direction, the head is propelled upwards. In this embodiment too, the plurality of propellant cylinders 2 too are connected with each to be pivotable about the transverse axis.

FIG. 20 illustrates the propelling process in which the propellant body 3 is propelled from the point A1 inside the pit T to cause the leading end of the propellant head 1 to reach a ground-surface point A3. More particularly, this process includes a lateral propelling step of propelling the head 1 from the underground point A1 to an underground point A2 (an example of second underground point) distant from the point A1 in the direction along the ground surface and a subsequent ascending propelling step of propelling the head 1 from the second underground point A2 to the predetermined ground-surface point A3 (an example of third point).

(LATERAL PROPELLING STEP)

In this lateral propelling step, the apparatus is to be propelled horizontally straight from the point A1 to the point A2. Thus, in the initial propelling step, when the thrust device M grips the first propellant cylinder 2 and propels this into the earth, the cylinder is propelled with maintaining the downward orientation of the pressure receiving face portion F. Then, as the orientation of the pressure receiving face portion F is switched over between the upward and downward orientations, the propellant head 1 is propelled generally horizontally as a result.

(ASCENDING PROPELLING STEP)

In this ascending step, the apparatus is propelled with maintaining the pressure receiving face portion F downwards, so as to push the lead 1 up to reach the ground surface.

Incidentally, in implementing this ascending step by the above-described method, it is important for a subsequent operation that the propellant head 1 arrive at a ground surface point as close as possible to the target point A3. And, the amount of deviation of the propellant head 1 from the target point when the ascending step is initiated at e.g. the second point A2 will be determined by an underground depth of the starting point of the ascending step and the conditions of the earth in the vicinity. Now provided that the underground depth of the starting position of the ascending process is known according to an actual operation, then, if the earth conditions are grasped with high precision to allow reckoning of an ascending path L denoted with a dot line in FIG. 20, then, it becomes possible to cause the propellant head 1 to reach the target point A3 with maximum precision.

In other words, the particulars (e.g. shape, length etc.) of the ascending path of the propellant head 1 from the point A2 to the point A3 in FIG. 20 will be determined by steering characteristics exhibited by the propellant head 1 relative to the particular ground conditions.

(LEARNING OF STEERING CHARACTERISTICS)

In this embodiment, the actual vertical steering characteristics of the propellant head 1 for the ground conditions are learned, that is obtained and stored in record during the lateral propelling step which precedes the ascending propelling step. And then, based on the obtained and stored characteristics, the steering characteristics (in this case, the most important is the characteristics to be exhibited by the propellant head when this head propelled upwards) of the propellant head 1 during the ascending propelling step are reckoned. This is based on a reasonable assumption that the ground conditions to be experienced during the ascending step will be similar that experienced during the lateral propelling step.

In the lateral propelling step, the learning of the actual vertical steering characteristics of the propellant head is possible by measuring an amount of deviation in the position of the propellant head when the head 1 has been propelled by a predetermined distance with maintaining the pressure receiving face portion F at a fixed orientation (e.g. the downward orientation with which the propellant head 1 may be propelled upwards). Then, based on the result of this learning, the ascending path L may be reckoned. As a result, a more appropriate point A2 as the staring point of the ascending step may be determined.

Figure 21:
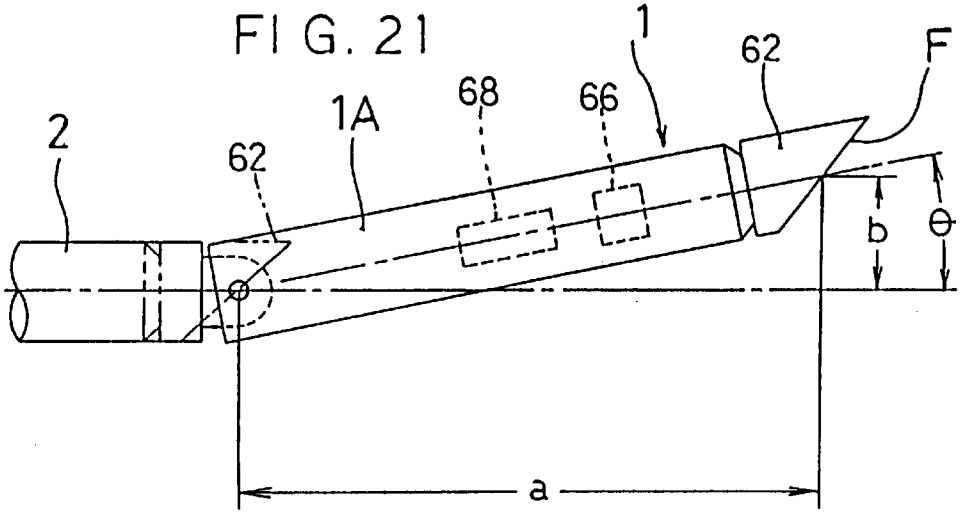
FIG. 21 is a concept view illustrating a measuring method of a deviation amount of position of a propellant head shown in FIG. 20.

In the above, a specific method of measurement of the deviation amount of the position of the propellant head 1 may be as follows. That is, as shown in FIG. 21, the propellant head 1 incorporates therein an orientation angle detecting means 68 capable of a vertical orientation angle θ of the axis P of the head 1 relative to the horizontal surface together with an inclination direction detecting means 66 capable of detecting whether the orientation of the inclined pressure receiving face portion F (whether an upward or downward). Then, provided that the propellant head 1 assumes an inclined posture as denoted by a solid line shown at the center of FIG. 21 after this propellant head 1 assuming a horizontal posture denoted by a double-dot line on the left side in FIG. 21 has been propelled by a predetermined amount (a) by the thrust device M, an ascending amount (b) of the leading end of the propellant head may be calculated by implementing the trigonometric principle from the vertical orientation angle θ and the predetermined amount (a). And, by using these two values (a), (b) as the amount of position deviation of the propellant head 1, the vertical steering characteristics of the propellant head 1 may be learned.

The propelling apparatus construction of the foregoing embodiments using the propellant head 1 and the cylinders 2 which are connected to be pivotable about only one pivot axis is suitable for implementing the above-described underground propelling method of this embodiment. However, the same technical concept may be applied in a method using a propellant apparatus which is pivotable about both a vertical axis and a lateral axis.

(4) A still further embodiment of the invention will be described next.

In this embodiment, the above-described propelling method is employed for installing a gas lead-in pipe 53 (an example of a pipe to be installed) between a gas main pipe 51 installed underground and a gas branch pipe C installed in a building construction 82. As the gas main pipe 51, the gas lead-in pipe 53 and the gas branch pipe C are communicated with each other, there is formed a continuous gas supply passage extending from the gas main pipe 51 to the building construction 82.

Generally, in this method of installing the gas lead-in pipe 53, the elongate propelling apparatus S is propelled under the ground to reach a ground-surface point 50 provided in the building construction 82, thus forming an underground hole H, into which the gas lead-in pipe 53 is drawn to be installed therein.

Figure 22:
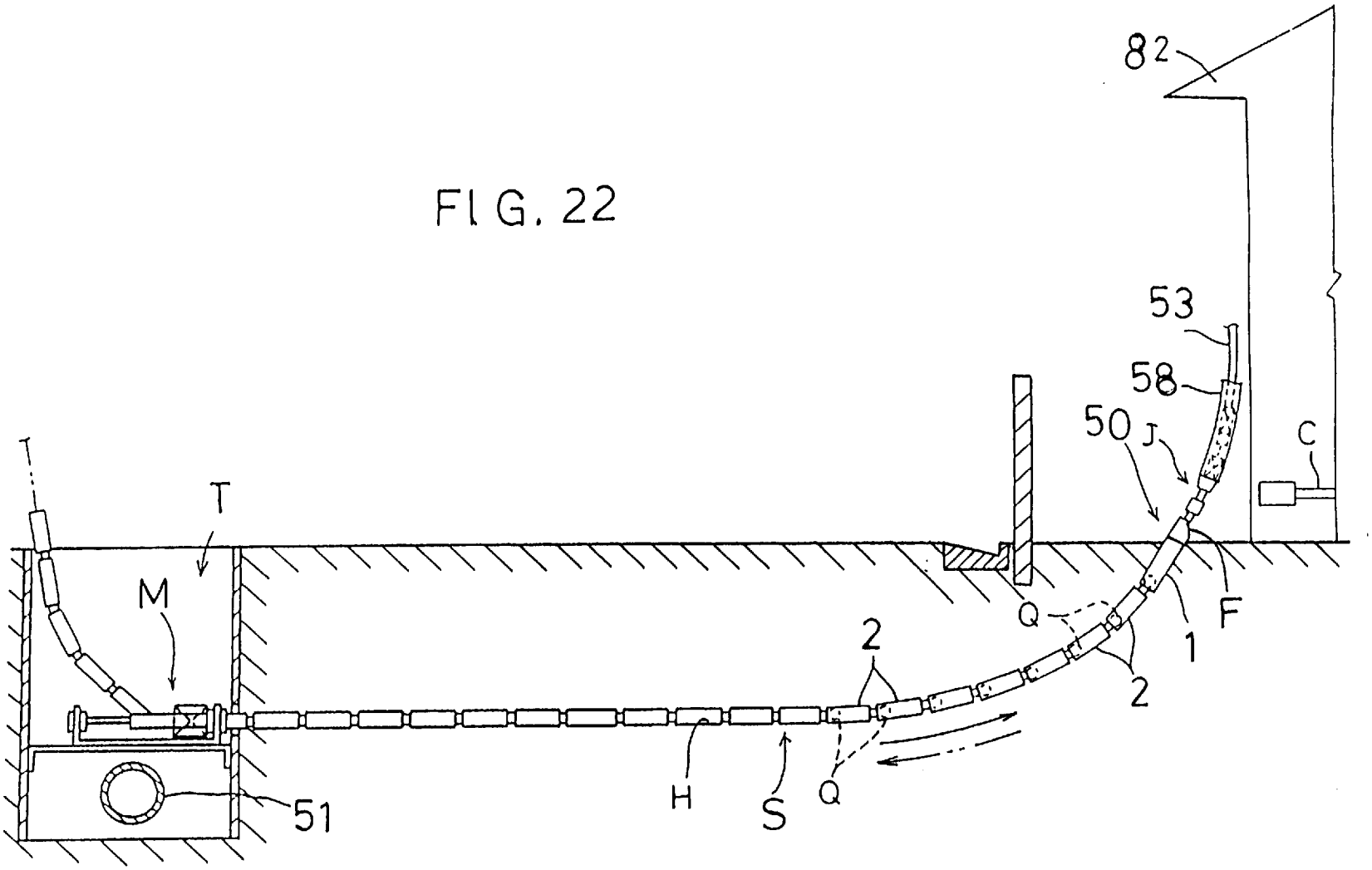
FIG. 22 is an explanatory view illustrating an installment condition of a pipe to be installed and a propellant apparatus according to a still further embodiment.

More particularly, in the propelling process for propelling the propellant apparatus S under the ground, as illustrated in FIG. 22, a pit T is dug at a predetermined ground-surface point above the gas main pipe 51, and a thrust device M is installed inside this pit T. Then, the thrust device M is activated to propel the propellant apparatus into the earth toward the building construction 82, so as to cause the apparatus S to reach the site of the building construction 82.

In the drawing step for drawing the gas lead-in pipe 53 into the underground hole, a corrugated tube 58, as an example of a sheath pipe, is fitted on the gas lead-in pipe 53 in advance. Then, to the leading end of the propellant apparatus S having reached the target ground-surface point 50, the gas lead-in pipe 53 and the corrugated tube 48 are together connected integrally by means of a connector metal element J. Thereafter, as the propellant apparatus S is drawn reversely into the underground hole, the gas lead-in pipe 53 and the corrugated tube 58 are together drawn into the hole to be installed therein.

Figure 23:
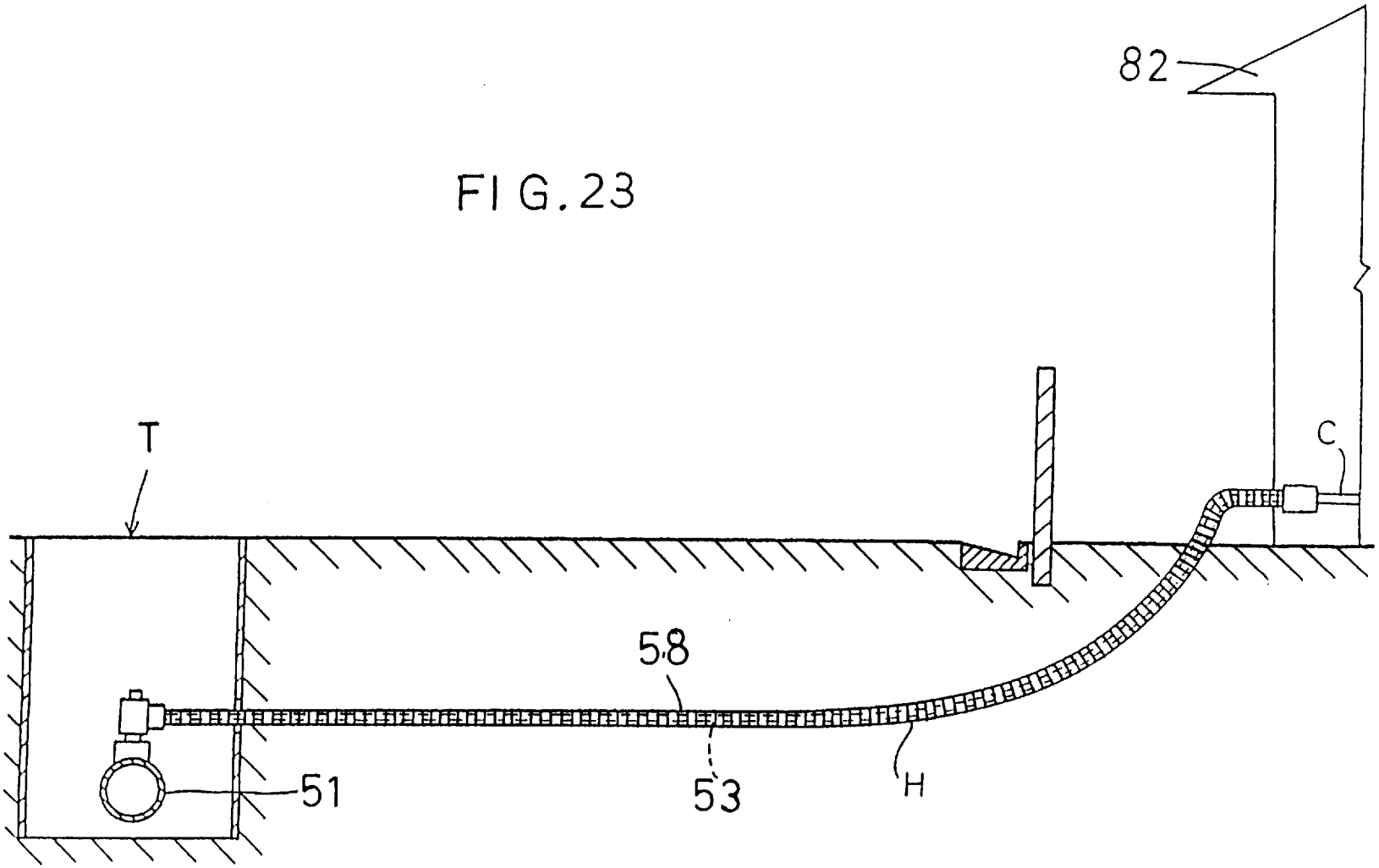
FIG. 23 is a view illustrating an installment condition of a lead-in gas pipe shown in FIG. 22.

When the corrugated tube 58 and the gas lead-in pipe 53 have been drawn into the pit T, the respective opposed ends of the gas lead-in pipe 53 are connected and communicated with the gas main pipe 51 and the gas branch pipe C, whereby the gas supply passage extending to the building construction 82 is established (see FIG. 23).

The gas lead-in pipe 53 is formed as a flexible pipe which is made specifically of resin material such as polyethylene.

The corrugated tube 58 to be fitted on the gas lead-in pipe 53 too is formed of resin and thus has flexibility.

The propellant apparatus S includes a plurality of cylinders 2 flexibly interconnected with each other via ball joints Q and a propellant head 1 attached to the leading end of these propellant cylinders 2. When the propellant apparatus S is propelled into the earth by the thrust device M with the pressure receiving face portion F formed at the leading end of the propellant head 1 being oriented to a predetermine direction, the propellant head 1 is guided in the direction along the pressure receiving face portion F, so that the apparatus may be propelled along a curved propelling path. Further, the propellant head 1 includes a metal member attaching portion 1C for allowing the attachment of the one end of the connecting metal member J for the pipe drawing process (see FIG. 24). The propellant apparatus has an outer dimension which is substantially equal to that of the corrugated tube 58.

The target ground-surface point 50 is set in advance at a predetermined location within the site of the building construction 82.

Figure 24:
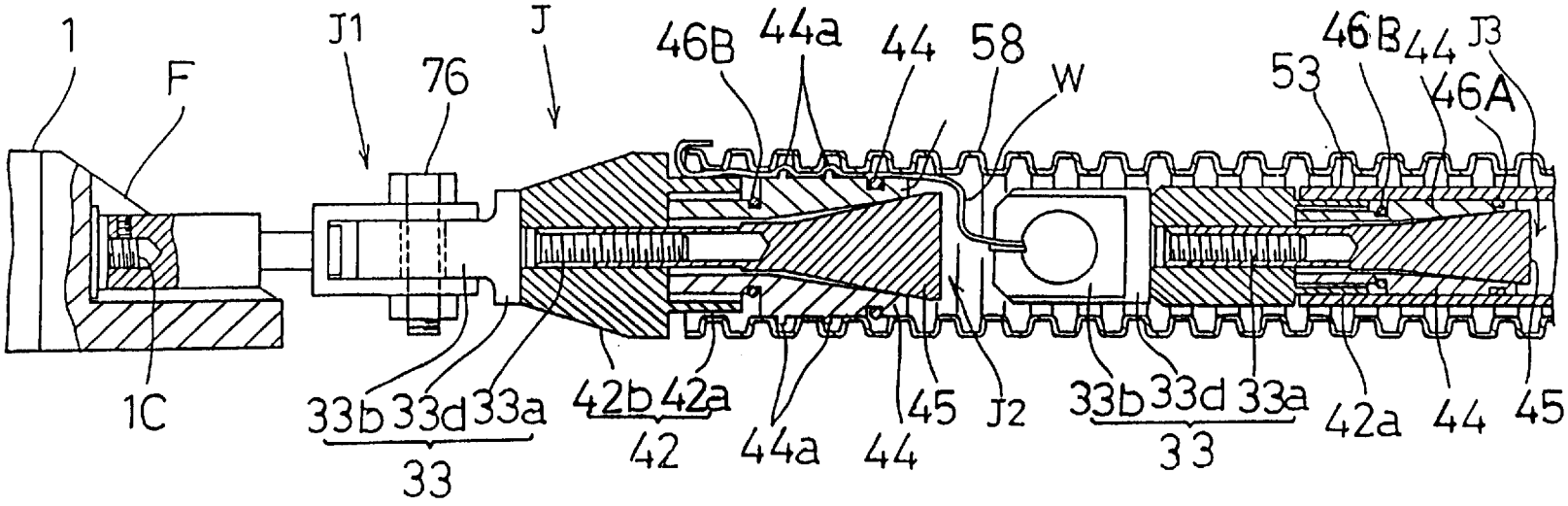
FIG. 24 is a partially cut-away view in section showing a connecting member for use in the propellant apparatus of FIG. 22.
Figure 25:
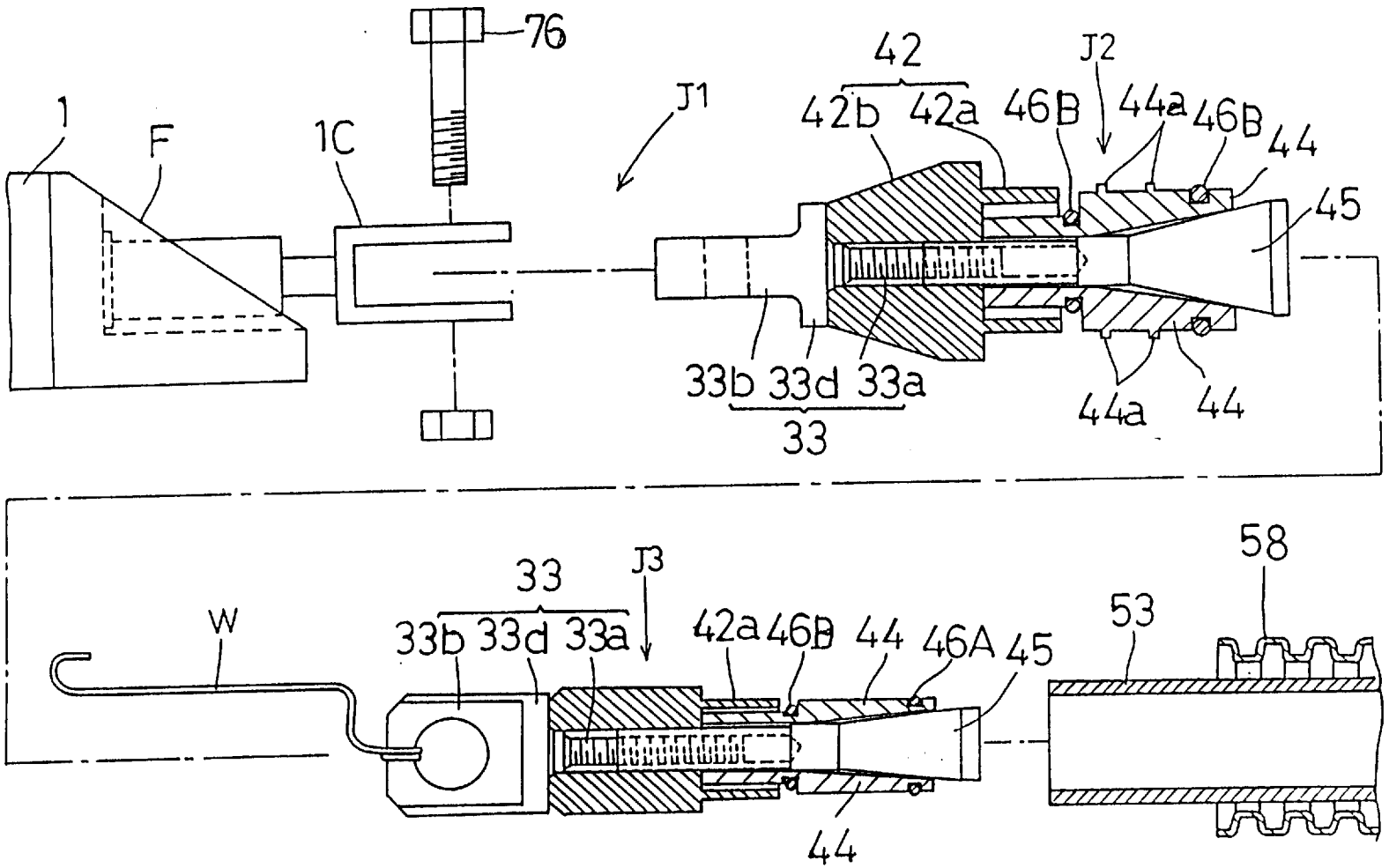
FIG. 25 is an exploded section view showing the connecting member of FIG. 24.
Figure 26:
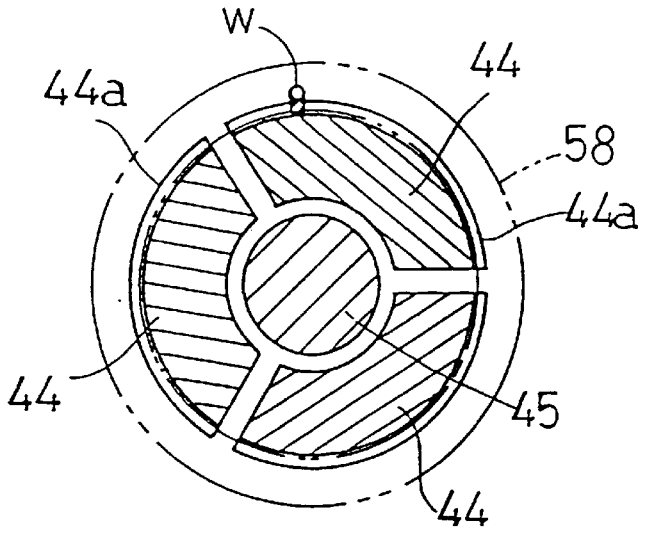
FIG. 26 is a horizontal section of the connecting member of FIG. 24.

The connecting metal member J, as shown in FIGS. 24, 25 and 26, includes a propellant apparatus side member J1 connectable to the metal member attaching portion 1C of the propellant head 1, and a corrugated tube connecting member J2 and a gas lead-in pipe connecting member J3 whose constructions will be described in greater details next.

The corrugated tube connecting member J2 comprises combination of a connector body 42, a male screw 33, a tapered cylinder 44 and a tapered shaft 45. At the leading end of the connector body 42, there is formed an inner engaging portion 42*a* which is engageable into the corrugated tube 58 from the leading end thereof. Further, the base end portion of the connector body 42 is formed as a conical portion 42*b* having a through hole at the center thereof and having a tapered base end outer periphery. The male screw 33 provides a transition between a direct connecting portion 33*b* to be directly connected with the propellant apparatus side member J1 via a connecting bolt 76 and a flange 33*d* which can come into contact with the base end face of the connector body 42. However, the connecting construction between the metal member attaching portion 1C of the propellant head 1 and the corrugated tube connector member J2 is not limited to the use of the connecting bolt 76 via the propellant apparatus side member J1. Alternatively, for instance, instead of forming the shape of the propellant apparatus side member J1 in the substantially C-shaped figure as shown in FIGS. 24, 25, the member may be provided to be retained within the propellant head 1 (to be rotated about an axis provided inside the propellant head 1 to be advanced or retracted, or to be advanced or retracted linearly), then, as illustrated in FIG. 22, when the propellant apparatus S is propelled toward the ground-surface target point 50, the propellant apparatus side member J1 is retracted within the propellant head 1. And, in connecting with the gas lead-in pipe 53, the propellant apparatus side member J1 is projected forwardly to be connected with the corrugated tube connecting member J2 by using e.g. a carabiner. Further, the carabiner or the like may be employed also for the connection between the corrugated tube connecting member J2 and the gas lead-in pipe connecting member J3. In this case, a hole for allowing insertion of the carabiner should be formed at the rear end of the tapered shaft 45.

The tapered cylinder 44 has its outer periphery engageable into the one end of the corrugated tube 58 fitted on the inner engaging portion 42*a* of the connector body 42. Moreover, an inner peripheral face of this tapered cylinder 44 is formed as a tapered conical face having an increasing diameter toward its leading end. Further, as shown in FIG. 26, the tapered cylinder 44 is comprised of three separate portions, which three separate portions are retained together by means of O rings 46A, 46B. Referring to the tapered shaft 45, the outer peripheral face of its leading end is formed as a tapered conical face with an increasing diameter towards the leading end thereof and gaplessly contactable with the inner peripheral face of the tapered cylinder 44, and at the base end portion of the shaft 45, there is formed a female threaded hole into which the male threaded portion 33*a* of the male screw 33 can be engaged.

With the corrugated tube connecting member J2 having the above-described construction, first, the connector body 42, the male screw 33, the tapered cylinder 44 and the tapered shaft 45 are assembled appropriately. Then, the one end of the corrugated tube 58 is inserted into the inner engaging portion 42*a* of the connector body 42. And, by increasing the amount of threaded engagement of the male threaded portion 33*a* of the male screw 33 inserted into the through hole of the conical portion 42*b* of the connector body 42 to the female threaded hole of the tapered shaft 45, by utilizing the wedge-like function between the tapered conical faces of the tapered cylinder 44 and of the tapered shaft 45, the entire split assembly of the tapered cylinder 44 is expanded in its diameter. With this diameter expansion, the corrugated tube connector member J2 may be engaged with the one end of the corrugated tube 58.

Incidentally, for more reliable engagement between the corrugated tube connector member J2 and the corrugated tube 58, the tapered cylinder 44 includes, in its outer peripheral face, projections 44*a* as shown in FIG. 24. Then, as these projections 44*a* come into the recesses defined in the inner periphery of the corrugated tube 58, longitudinal relative movement between the corrugated tube connector member J2 and the corugated tube 58 may be restricted. As the result, the pipe drawing force may be effectively transmitted and also inadvertent disengagement may be effectively avoided. Incidentally, the leading end of the projection 44*a* is formed flat in FIGS. 24, 25. Instead, this leading portion may be formed pointed with tapering. Further, the projection 44*a* may be provided also in the outer peripheral face of the tapered shaft 44 used in the gas lead-in pipe connecting member J3, thus providing a construction similar to that of the corrugated tube connecting member J3 described above.

The gas lead-in pipe connector member J3 has a smaller diameter than the above-described corrugated tube connector member J2, so that the member J3 can be inserted into the member J2. Then, the construction of this connector member J3 is substantially same as that of the corrugated tube connector member J2, except that the member J2 does not have the conical portion 42*b* and the projections 44*a*. Needles to say, the gas lead-in pipe connector member J3 too may be provided with the projection 44*a*. The gas lead-in connector member J3 is connected, with one end of a metal wire W having the other end thereof connected with the direct connecting portion 33*b* being fitted between the corrugated tube connector member J2 and the corrugated tube 58. Incidentally, in place of this connecting construction, the carabiner or the like may be employed, as described above. Needless to say, in a manner similar to the connection between the corrugated tube connector member J2 and the corrugated tube 58, the gas lead-in pipe connector member J3 may be connected with the gas lead-in pipe 53.

According to the above-described method of installing the gas lead-in pipe 53, the installing operation may be effected with effectively preventing the gas lead-in pipe 53 from being damaged. Moreover, the propelling step for forming the underground hole H and the pipe drawing step for drawing the target pipe into the hole H may both be effected with high efficiency. Then, the efficiency of the entire pipe installing operation may be improved.

(1) The pipe to be installed is not limited to the gas supply pipe described in the foregoing embodiment. The pipe may alternatively be a water pipe for supplying water, fuel supply pipe or sewage pipe and so on. And, these pipes are generically referred to as the pipe to be installed.

(2) The sheath pipe is not limited to the corrugated tube described in the foregoing embodiment. The sheath pipe may alternatively be a common round pipe having no surface uneveness in its periphery. These pipes are generically referred to as the sheath pipe.

(3) The underground propelling step is not limited to the type described in the foregoing embodiment in which the pit T is formed and the thrust device M is disposed inside this pit T prior to the propelling step. For instance, the propelling step may be initiated by propelling the apparatus from a ground-surface start point into the ground.

(5) A still further embodiment of the present invention will be described next.

Figure 27:
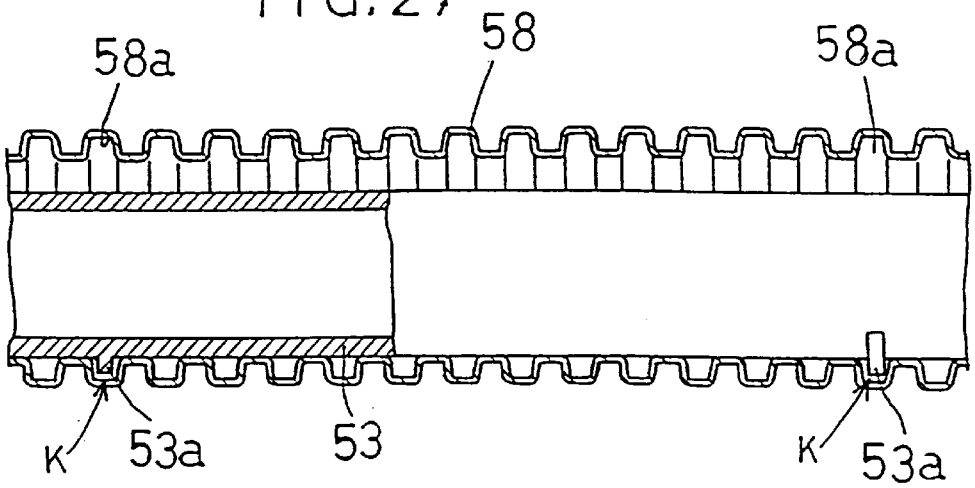
FIG. 27 is an explanatory view showing a pipe to be installed and a sheath pipe which are together connected with the propellant apparatus of FIG. 22, FIGS. 28*a–b* are explanatory views showing the pipe and the sheath pipe of FIG. 27.
Figure 28:
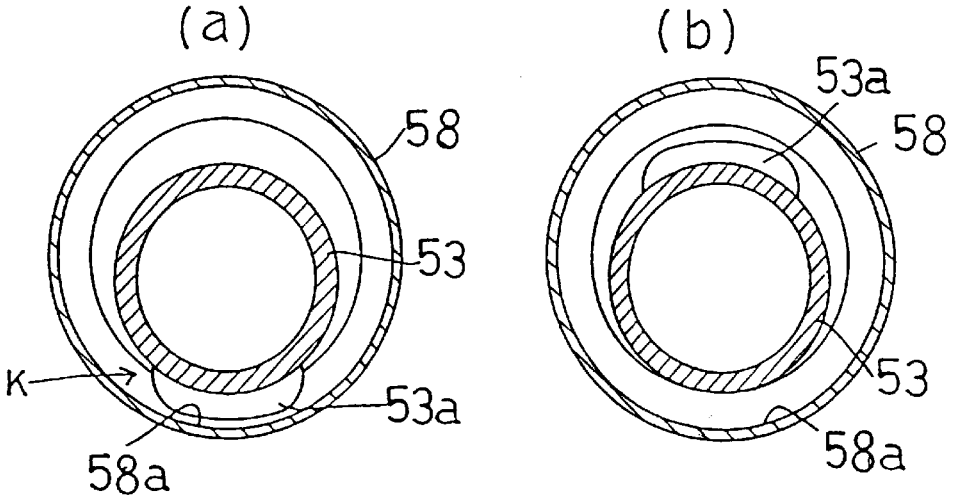

In case the ground in which the pipe is to be installed tends to invite a landslide or has a large amount of gravel, a significant frictional resistance may be applied to the sheath pipe during the pipe drawing step, thus generating a large pulling load. In such case, by providing a restricting means K for restricting relative longitudinal movement between the pipe and the sheath pipe between these pipes, it becomes possible for the load to be received by the two pipes, whereby elongation, deformation or any other damage of the sheath pipe may be advantageously avoided. An example of such restricting means K is shown in FIGS. 27 and 28.

In this further embodiment, in an outer peripheral face of the gas lead-in pipe (an example of a pipe to be installed), there are formed projections 53*a* with a predetermined longitudinal distance therebetween, the projection 53*a* being engageable into recesses 58*a* in the inner peripheral face of the corrugated tube (an example of the sheath pipe 58). Then, as shown in FIG. 28(*a*), the posture of the gas lead-in pipe 53 is set such that the projections 53*a* are directed downwards to come into engagement with the inner peripheral recesses 58*a*, whereby the longitudinal relative movement between the gas lead-in pipe 53 and the corrugated tube 58 is restricted to allow the pulling load to be received by both of the pipes. On the other hand, when the posture of the gas lead-in pipe 53 is set in such a manner that the projections 53*a* are directed upwards not to engage into the inner peripheral recesses 58*a* (FIG. 28(*b*)), the longitudinal relative movement between these pipes is allowed, so that e.g. the inserting operation of the gas lead-in pipe 53 into the corrugated tube 58 may be effected readily and smoothly. That is, the inner peripheral recesses 58*a* and the projections 53*a* together constitute the restricting means K. However, the particular construction of this restricting means K is not limited to the type of the foregoing embodiment in which these portions are formed integral with the corrugated tube 58 or the gas lead-in pipe 53. Instead, the restricting means K may be provided as separate members.

(6) Next, a still further embodiment of the invention including a propelling steering control receiver device usable in the above-described propelling methods will be described.

Figure 29:
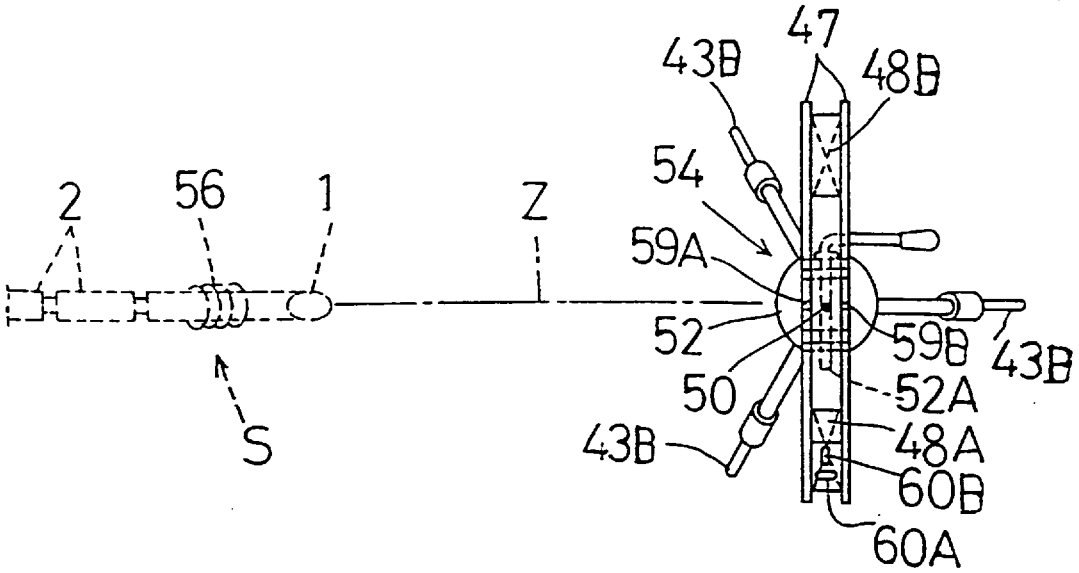
FIG. 29 is a plan view illustrating a condition in which a propelling method is being implemented with using a steering control receiver device usable in the propelling method of the invention.
Figure 30:
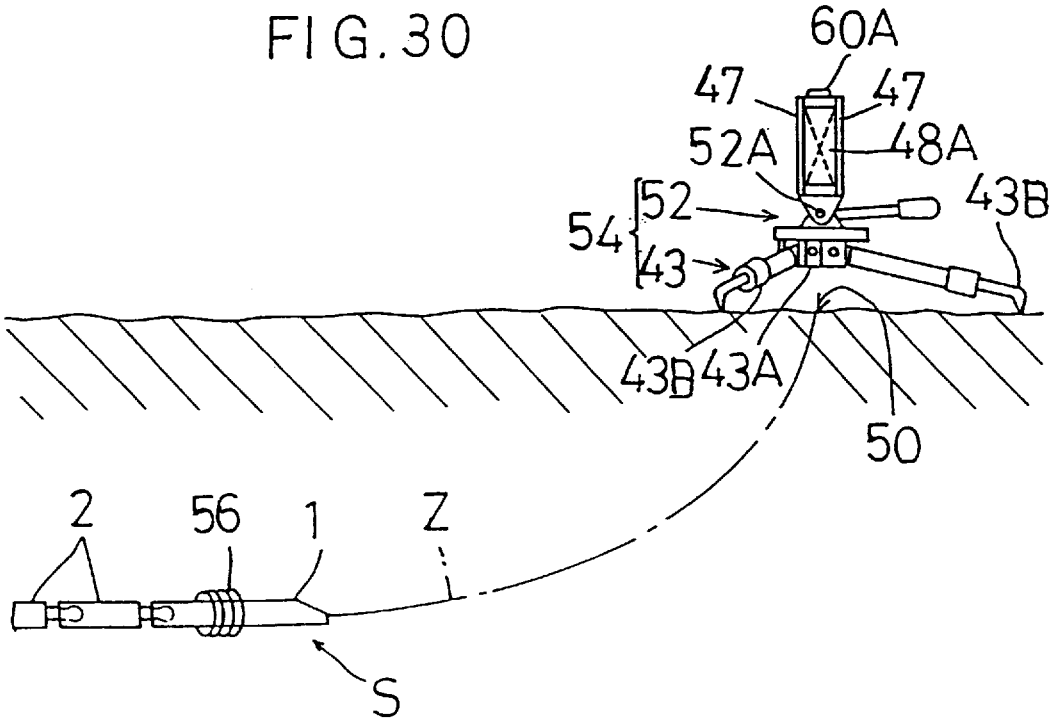
FIG. 30 is a side view of FIG. 29.
Figure 31:
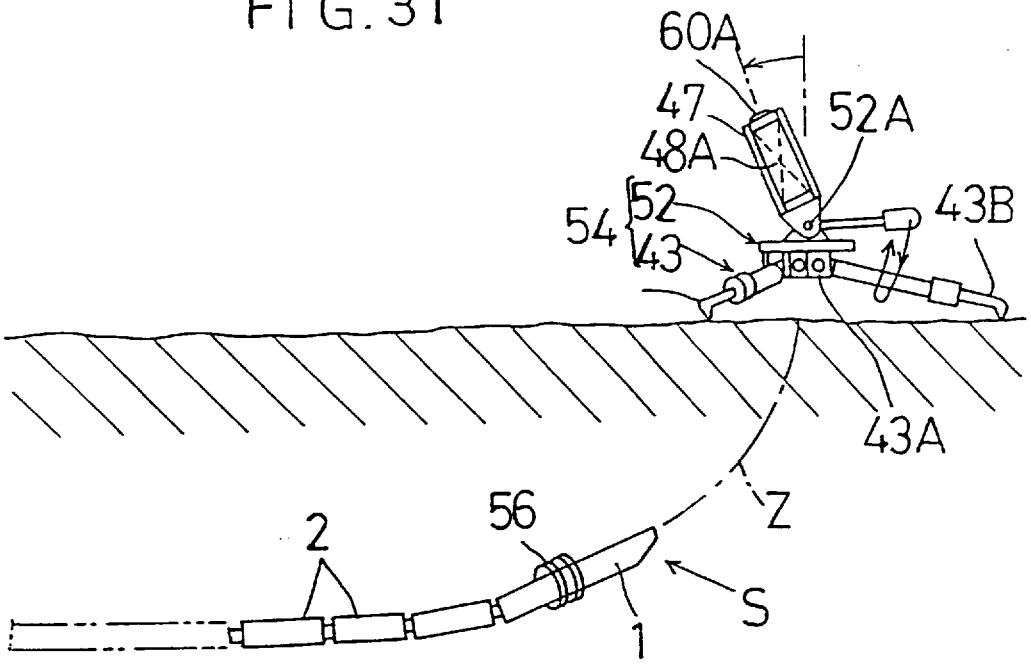
FIG. 31 is a side view of FIG. 29.

A propellant apparatus S includes a plurality of propellant cylinders 2 flexibly connected with each other and a propellant head 1 attached to the leading end of the propellant cylinders 2. FIGS. 29 through 31 show a condition in which this propellant apparatus S is propelled under the ground to reach a target point 50 (in this embodiment, a ground-surface point). In the following description, the propelling direction of the propellant apparatus S will be referred to as the fore and aft direction, and the direction extending normal thereto will be referred to as the right and left direction, respectively.

Next, the receiver device for use in the above situation will be described.

First, the receiver device includes a pair of receiver coils 48A, 48B capable of receiving electromagnetic wave from a transmitter coil 56 attached to the leading head (i.e. the propellant head 1) of the propellant apparatus S and having an axis extending along the axis of the head. Specifically, the transmitter coil 56 is wound about the outer peripheral face of the propellant head 1 (but, not exposed on the outer peripheral face), as illustrated in FIGS. 29 through 31. Then, the transmitter coil 56 receives power from a power supply means (not shown) provided at the base end of the propellant apparatus S for transmitting the electromagnetic wave. This transmitter coil 56 is capable of distributing a region of strong electromagnetic wave on the axis thereof. The pair of receiver coils 48A, 48B are connected with each other by means of a fixing frame 47 for mounting these coils side by side with the respective axes thereof being oriented in a same direction. Further, the fixing frame 47, as shown in FIGS. 30 and 31, is attached to a fixing frame stand 54 and installed at the ground-surface target point 50.

Figure 32:
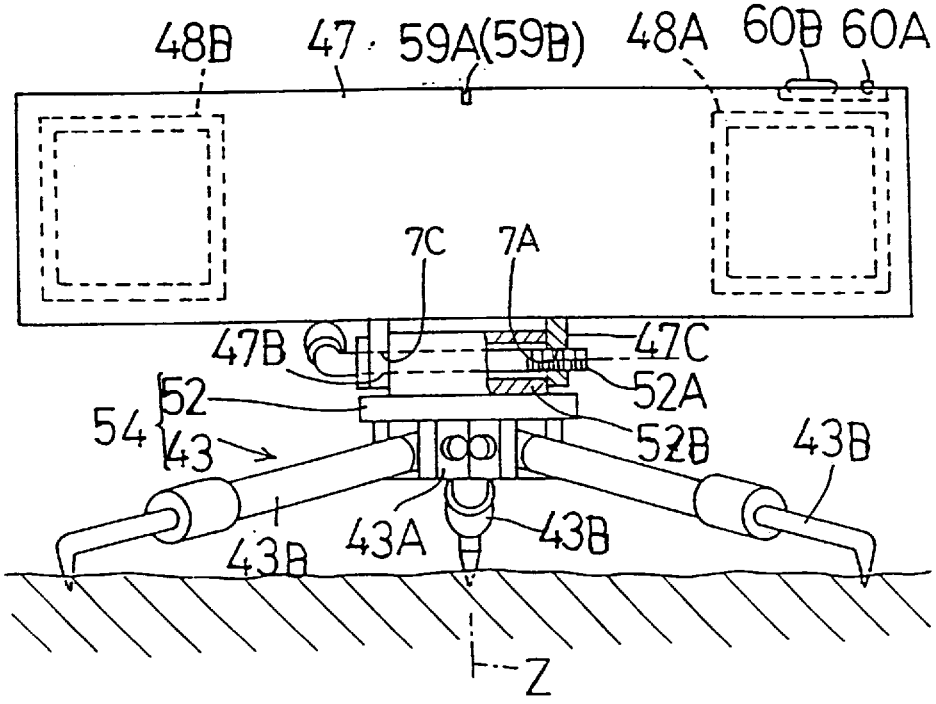
FIG. 32 is a front view of the receiver device of FIG. 29.
Figure 33:
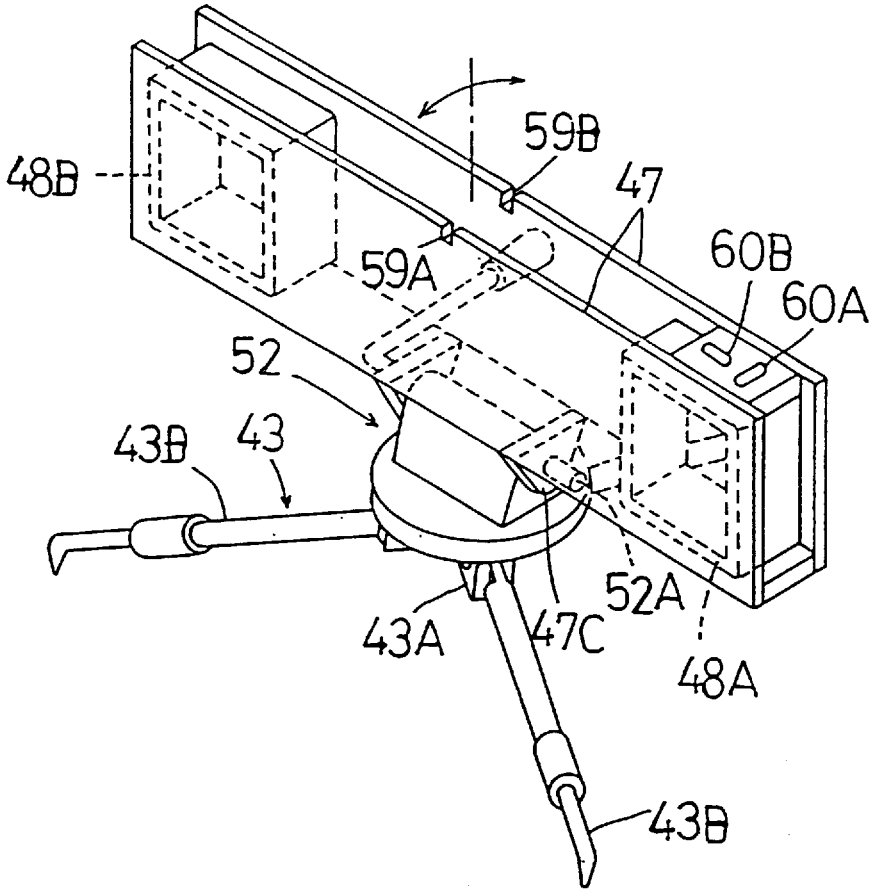
FIG. 33 is a perspective view of the receiver device of FIG. 32.

As shown in FIGS. 32, 33, the fixing frame stand 54 includes a pan and tilt head 52 for mounting the fixing frame 47 thereon and a tripod 43. The tripod 43 includes a tripod head 43A and three pods 43B which may be respectively pivotal relative to the head 43A and which may be fixed in respective pivotal position. The tripod head 43A is fixed to the bottom of the pan and tilt head 52.

Further, the fixing frame 47 is pivotally threaded to the pan and tilt head 52 so that the pivot axis thereof is aligned with the right and left direction of the fixing frame 47, i.e. the direction of the axes of the pair of receiver coils 47A, 47B. More particularly, on the top face of the pan and tilt head 52, there is fixedly attached a bearing portion 52B for allowing a male screw member 52A to extend parallel with the top face of the pan and tilt head 52. At the center of the bottom place of the fixing frame 47, there are formed a pair of projections 47C projecting downward and in symmetry in the right and left direction. Further, one of the pair of projections 47C defines a female threaded hole 47A and the other defined a shaft hole 47B, respectively. In order to allow the pair of projections 47C to bind the bearing portion 52B from the right and left sides thereof, the male screw member 52A is inserted through the shaft hole 47B and the bearing portion 52B to be threaded into the female threaded hole 47A. Then, by adjusting a handle position provided on the male screw member 52A, the strength of the binding force of the pair of projections 47C for binding the bearing portion 52B from the right and left sides may be adjusted. When the binding strength is reduced, the fixing frame 47 becomes pivotable relative to the fixing frame stand 54, so as to adjust an angle of depression at which the respective axes of the pair of receiver coils 48A, 48B cross the horizontal plane. Conversely, when the binding strength is increased, the fixing frame 47 may be fixedly maintained at a position of a desired depression angle.

By rendering the fixing frame 47 pivotable to adjust its pivotal position prior to or after or during the propelling operation, the depression angle at which the axes of the pair of receiver coils 48A, 48B cross the horizontal plane may be readily and speedily varied, e.g. from the condition shown in FIG. 30 to the condition shown in FIG. 31, whereby the intensity of the electromagnetic wave received by the pair of receiver coils 48A, 48B may be at its maximum. Consequently, it is possible to constantly maintain the optimum reception condition.

As shown in FIGS. 32 and 33, at the front and rear positions at the sidewise center of the fixing fame 47, there are provided position adjusting means 59A, 59B relative to the planned propelling line Z. Specifically, these position adjusting means 59A, 59B are provided as cutouts formed at the front and rear positions at the sidewise center of the fixing frame 47 corresponding to the planned propelling direction Z.

The receiver device includes a first level 60A for providing the fore and aft level of the pair of receiver coils 48A, 48B and a second level 60B for providing the right and left level of the same. These first and second levels 60A, 60B, as illustrated in FIG. 33, are attached to the top of a case accommodating one (in this embodiment, the right-side receiver coil 48A relative to the propelling direction) of the pair of receiver coils 48A, 48B so as to be visible from the top.

When the receiver device having the above-described construction is to be put into use, first, the pan and tilt head 52 of the fixing frame 47 is immobilized and in this condition, the sidewise center of the fixing frame 47 is aligned with the planned propelling direction Z by using the position adjusting means 59A, 59B and also by adjusting the positions of the three pods 43B of the fixing frame stand 54, the pair of receiver coils 48A, 48B may be readily disposed in the side symmetric arrangement on the right and left sides of the perpendicular plane. Accordingly, even if the ground surface on which the pair of receiver coils 48A, 48B has surface uneveness as shown in FIG. 30 or 31, unlike the conventional art, it is not necessary to dispose each of the pair of receiver coils with great care. So, that the disposing operation of the receiver coils has been significantly facilitated, in comparison with the conventional art. Also, with the use of the first and second levels 60A, 60B, references for obtaining the fore and aft direction and the right and left direction may be readily obtained and therefore the efficiency of the operation for disposing the pair of receiver coils 48A, 48B in the side symmetric arrangement may be significantly improved. Further, by adjusting the positions of the three pods 43B of the fixing frame stand 54 based on the levels, the disposing positions of the pair of receiver coils 48A, 48B may be readily set to the horizontal posture.

In this embodiment, it is also preferred that depression angle control means 61 be provided to the fixing frame 47 or to the fixing frame stand 54 so as to automatically control the fixing position of the fixing frame 47 relative to the pan and tilt head 52 in accordance with the intensity of the electromagnetic wave received by the pair of receiver coils 48A, 48B.

(7) A further embodiment relating to the receiver device will be described next with reference to FIGS. 34 and 35.

First, like the foregoing embodiment shown in FIGS. 32 and 33, the pair of receiver coils 48A, 48B are connected together by means of the fixing frame 47 for attaching the coils with the respective axes thereof being oriented in the same direction. Further, the fixing frame 47 is attached to the fixing frame stand 54. At the front and rear positions at the sidewise center of the fixing frame 47, there are provided position adjusting means 59A, 59B relative to the planned propelling line Z. Further, a first level 60A for providing the fore and aft level of the pair of receiver coils 48A, 48B and a second level 60B for providing the right and left level of the same are attached to the top of a case accommodating one of the pair of receiver coils 48A, 48B so as to be visible from the top.

Figure 34:
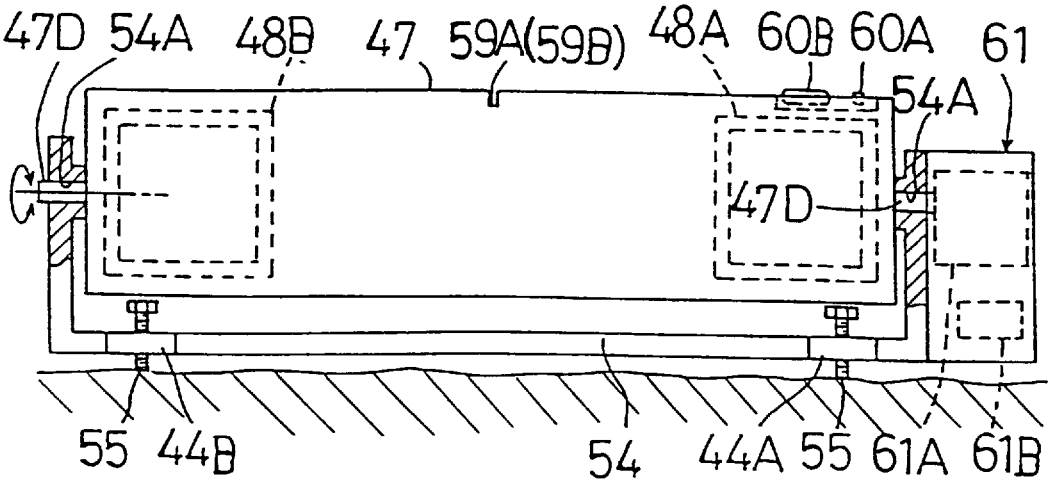
FIG. 34 is a front view of a receiver device according to a further embodiment.
Figure 35:
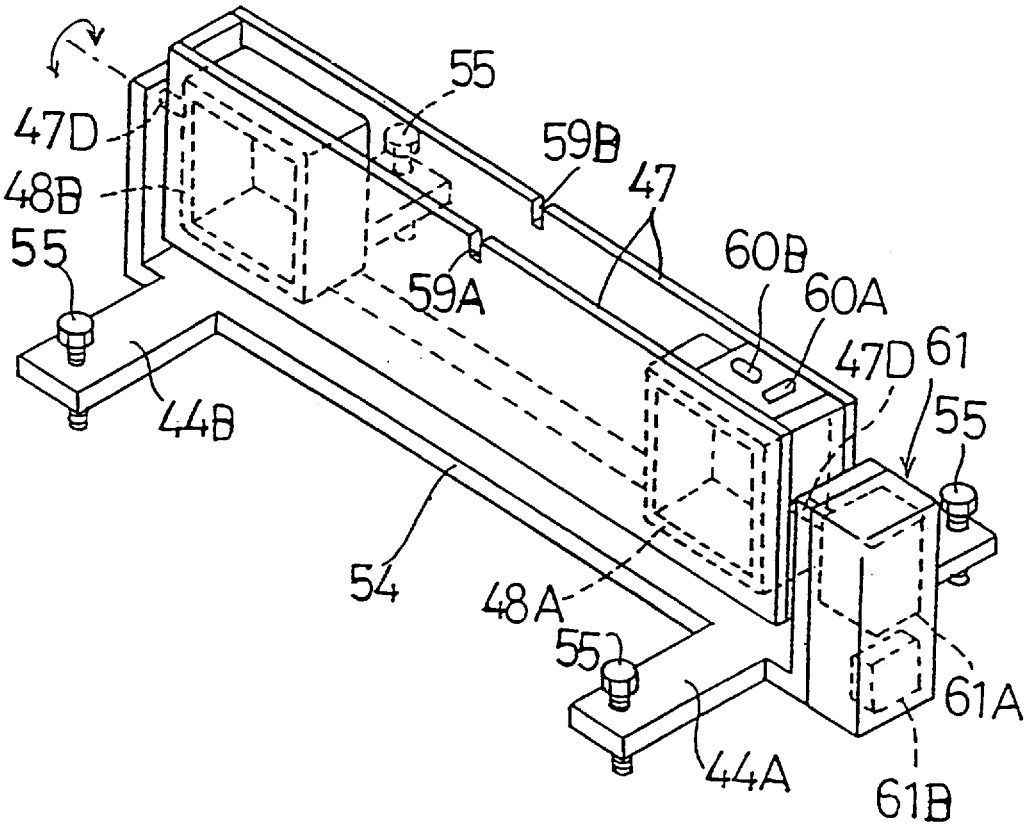
FIG. 35 is a perspective view of the receiver device of FIG. 34.

Further, as shown in FIGS. 34 and 35, the fixing frame 47 include, mounts, in right and left side faces thereof, two shaft members 47D to be rotatably supported to the fixing frame stand 54. The fixing frame stand 54 includes, in right and left side plates thereof, through holes 54A for introducing the shaft members 47D therethrough.

To one side plate of the fixing frame stand 54, there is attached a depression angle control means 61. This depression angle control means 61 includes a drive means 61A for forwardly and reversely rotating the shaft member 47D projecting from the one side plate to which this depression angle control means 61 is attached and capable of fixedly maintaining the shaft member 47D at a desired angular position and control means 61B for controlling ON/OFF and forward and reverse rotations of the drive means 61A based on the intensity of the electromagnetic wave received by the pair of receiver coils 48A, 48B.

The control means 61B is switchable between a manual control mode and an automatic control mode. In the automatic control mode, the control means 61B constantly detects variation in the electromagnetic wave intensity and turns ON the drive means 61A when the intensity has decreased, so as to provide the forward drive force to the shaft member 47D in the direction to increase the depression angle formed between the axes of the receiver coils 48A, 48B and the horizontal plane. When the electromagnetic wave intensity is increasing, the control means causes the drive means to keep providing the forward rotational drive to the shaft until an amount of change per unit rotation angle becomes smaller than a predetermined value. If the intensity decreases, the rotation direction is switched over, so as to keep providing the reverse rotation drive until the change amount per unit rotation angle becomes smaller than the predetermined value.

Further, at the right and left opposed ends of the fixing frame stand 54, there are attached support plates 44A, 44B respectively supporting the ends and extending in the fore and aft direction. To these support plates 44A, 44B, at four positions, i.e. right and left and forward and rear positions, there are attached height adjusting means 55. The height adjusting means 55, as shown in FIGS. 34 and 35, are comprised of bolts which are threadably inserted into the female threaded holes defined at the forward and rear ends of the support plates 44A, 44B and which can be fixed in position at an appropriate height, respectively.

When the receiver device having the above-described construction is to be put into use, first, the drive means 61A is turned OFF in the manual control mode. Then, the fixing frame 47 is maintained in a condition fixed to the fixing frame stand 54. Then, while aligning the sidewise center of the fixing frame 47 to the planned propelling line Z by using the position adjusting means 59A, 59B, this assembly is disposed with consideration to its overall posture. With these simple operations, the pair of receiver coils 48A, 48B may be readily disposed in the side symmetric arrangement on the right and left sides of the perpendicular plane. Accordingly, even if the ground surface on which the pair of receiver coils 48A, 48B has surface uneveness as shown in FIG. 34, unlike the conventional art, it is not necessary to dispose each of the pair of receiver coils with great care. So, that the disposing operation of the receiver coils has been significantly facilitated, in comparison with the conventional art. Further, by using the first and second levels 60A, 60B, the references for obtaining the levels in the fore and aft direction and the right and left direction may be readily obtained. And, base on these references, the disposing posture of the pair of receiver coils 48A, 48B may be readily adjusted to the horizontal by using the height adjusting means 55. Further, as the support plates 44A, 44B extend in the fore and aft direction, an overturning accident of the receiver device due to e.g. a wind in this direction may be avoided advantageously.

Further, after the start of propelling operation, by switching over the control means 61B to the automatic control mode, the depression angle formed between the axes of the pair of receiver coils 48A, 48B and the horizontal plane may be automatically adjusted so as to maximize the intensity of the electromagnetic wave received by the pair of receiver coils 48A, 48B. Consequently, the receiver device may be constantly maintained at a good reception condition without necessitating manual operation.

In the above embodiment, instead of providing the depression angle control means 61, a male threaded groove may be provided on the shaft member 47D, so that the fixing frame 47 may be fixed to the fixing frame stand 54 by using e.g. a female screw member such as a butterfly screw. In this case, by loosening the threaded engagement of the female screw member, the fixing frame 47 is rendered pivotable while being supported to the fixing frame stand 54.

Further, the depression angle control means 61 may be provided inside the fixing frame 47. In this case, the shaft member 47D is fixed to the fixing frame stand 54, and the fixing frame 47 is pivotable relative to the fixing frame stand 54 due to rotational drive transmitted from the depression angle control means 61 to the fixing frame stand 54.

(8) A still further embodiment of the invention will be described next.

This embodiment is provided for further facilitating the steering control of the propellant head. A propelling control device M2 employed in this embodiment includes, for the purpose of facilitating the steering control of the propellant head 1 in the horizontal direction in particular, a horizontal direction determining means 23 (to be referred to briefly as 'determining means 23' hereinafter) for determining a propelling condition based on magnetic field intensities obtained from a pair of magnetic field detecting means 22 which respectively detect a magnetic field generated by a magnetic field generating means 21 attached to the propellant head 1. Further, this determining means 23 includes a magnetic field intensity ratio detecting means 23*a* for obtaining a magnetic field intensity ratio 24 by comparing the magnetic field intensities detected by the pair of magnetic field detecting means 22 and a magnetic field intensity correcting means 23*b* for correcting the magnetic field intensity ratio 24. The correction of the magnetic field intensity ratio 24 is effected in such a manner that the higher the magnetic field intensity, the greater a remaining distance U, i.e. a distance between the propelling position of the propellant head 1 and the target point P2, for instance.

Figure 36:
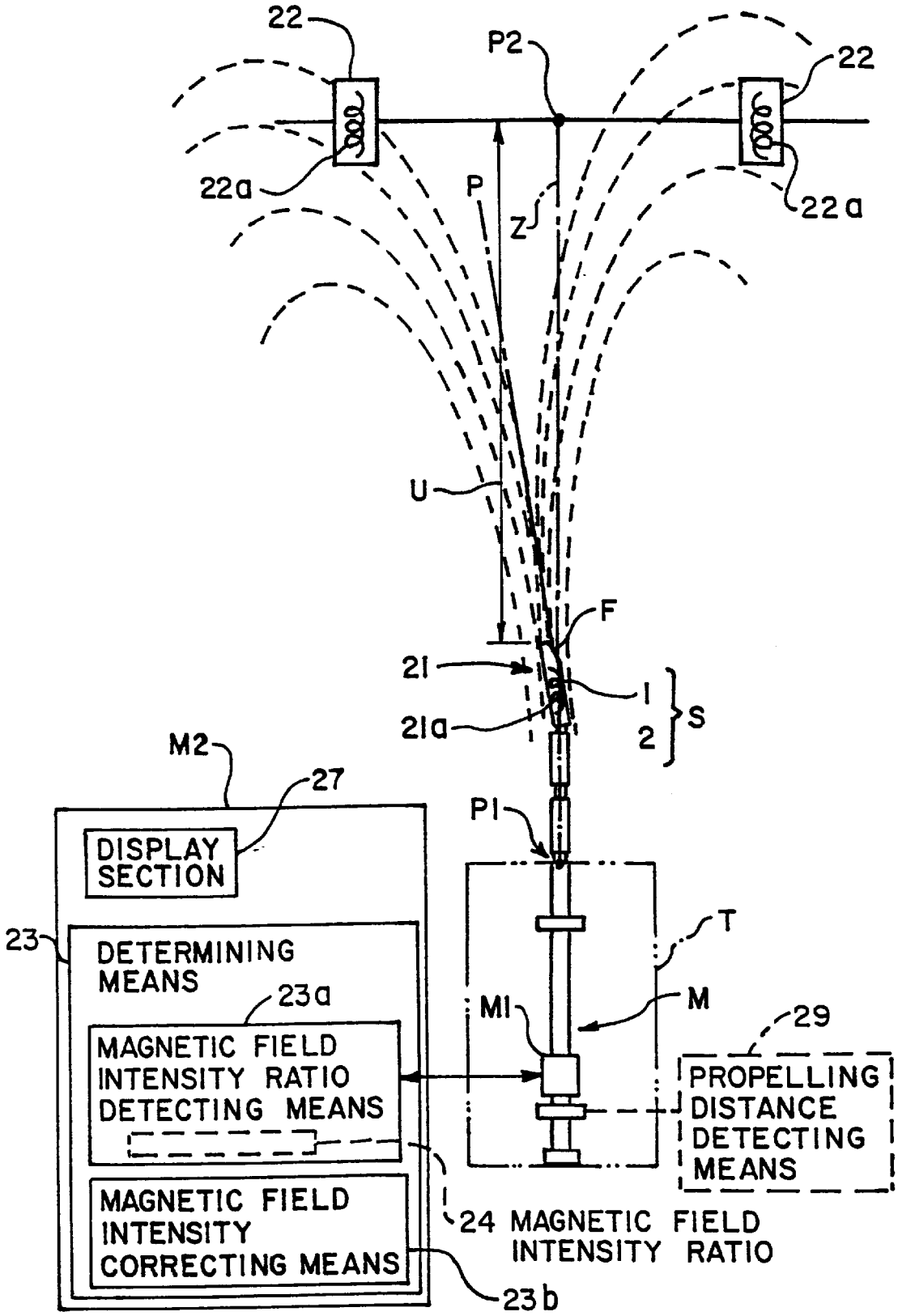
FIG. 36 is a schematic view showing a top outer appearance of a propellant apparatus for use in a still further embodiment of the invention.
Figure 40:
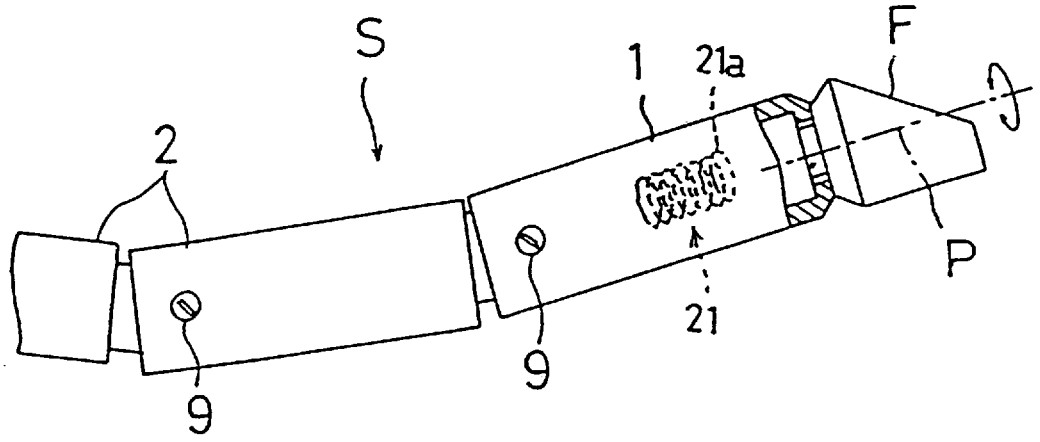
FIG. 40 is an outer appearance view of the propellant apparatus of FIG. 36.

Specifically, as shown in FIG. 36, the horizontal steering is effected by using a transmitter coil 21*a,* as the magnetic field generating means 21, attached to the propellant head 1 and a pair of receiver coils 22*a* provided at the target point P2 as the magnetic filed detecting means 22. The transmitter coil 21*a,* as shown in FIG. 40, is attached to the propellant head 1, with the axis of the coil being substantially parallel with the axis P of the propellant head 1.

A change in the position of the propellant head 1 is grasped by obtaining the magnetic field intensity ratio 24 by comparing the magnetic field intensities detected respectively by the pair of receiver coils 22*a* installed at the target point P2. This magnetic field intensity 24 needs to be evaluated with correction made in accordance with the propelling distance of the propellant head 1. For this reason, the propelling control device M2 of this embodiment includes the magnetic field intensity ratio correcting means 23*b*.

This magnetic field intensity ratio correcting means 23*b* obtains a ratio between induced voltages generated by the respective receiver coils 22*a* and corrects this voltage ratio in accordance with the propelling distance. The propelling distance, in this case, is evaluated according to the remaining distance U between the current position of the propellant head 1 and the target point P2. If the evaluation is made according to the remaining distance as described above, even when the length of the planned propelling path Z differs from one construction work site to another, the entire length of the planned propelling path Z does not affect the correction, so that the same correction method may always be implemented. For instance, the remaining distance U may be obtained by first obtaining the distance across which the propellant head 1 has been propelled and then subtracting this distance from the total length of the planned propelling path Z. The distance covered by the propellant head 1 may be obtained by calculating, by using the propelling distance detecting means 29 provided in the thrust device M, strokes of the thrusting operation on the propellant cylinders 2 connected to the rear end of the propellant head or counting the number of the propellant cylinders 2 connected.

The correction of the magnetic field intensity ratio 24 is effected by using e.g. a linear function using the remaining distance U as a parameter or n-th function. Determination as to which of these functions is to be used may be made by prior experiment with consideration to the topographycal conditions A of each work site, for instance. In either case, the correction amount of the magnetic field intensity ratio 24 when there remains a long remaining distance U should be larger than the correction amount when there remains a short remaining distance U.

Figure 39:
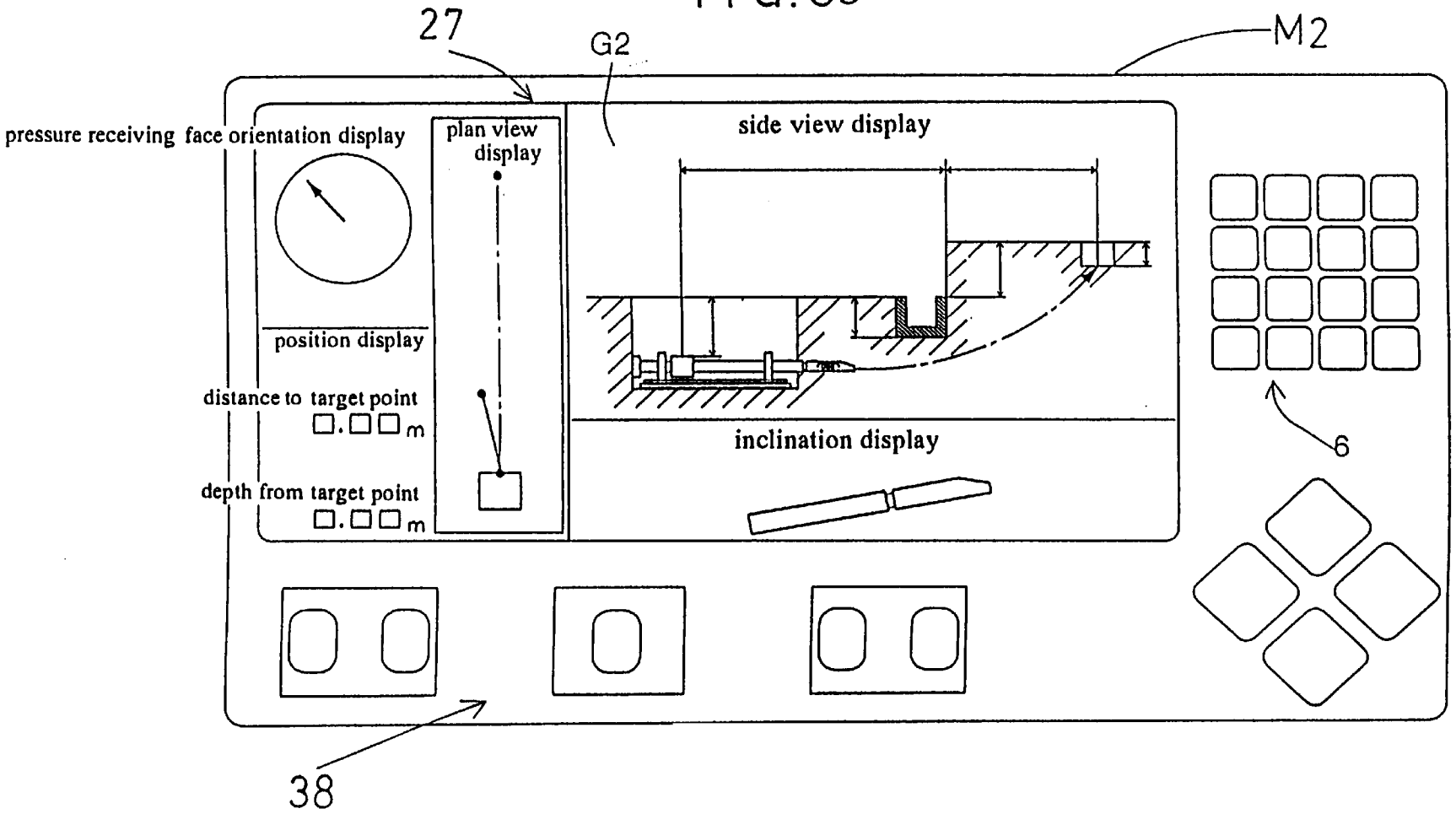
FIG. 39 is a schematic showing the control panel and a second screen of the propellant apparatus of FIG. 36.

As shown in FIG. 39, on a planar display of a second screen G2 of a control panel, the planned propelling path Z and the current position of the propellant head 1 relative to the target point P2 are displayed. For instance, when the propellant head 1 is deviated to the left side relative to the target point P2, the position of the head is shown on the left side of the planned propelling path Z. And, the greater the amount of deviation of the propellant head 1, the farther the position thereof is plotted relative to the planned propelling path Z.

With the above-described construction, an operator can steer the propellant head while observing the planar display. And, regardless of the amount of the remaining distance U, the image display displays the deviation amount of the propellant head 1 relative to the planned propelling path Z according to the constant evaluation scheme. Hence, the operator may steer the propellant head 1 always in the same manner, regardless of the amount of the remaining distance. This means that the display is made as just expected by the operator. Therefore, the operator may steer the propellant head 1 with natural operation feel.

As described above, the present embodiment has achieved a propellant apparatus whose propellant head 1 may be steered with great ease, regardless of the propelling position of the propellant head 1.

Figure 37:
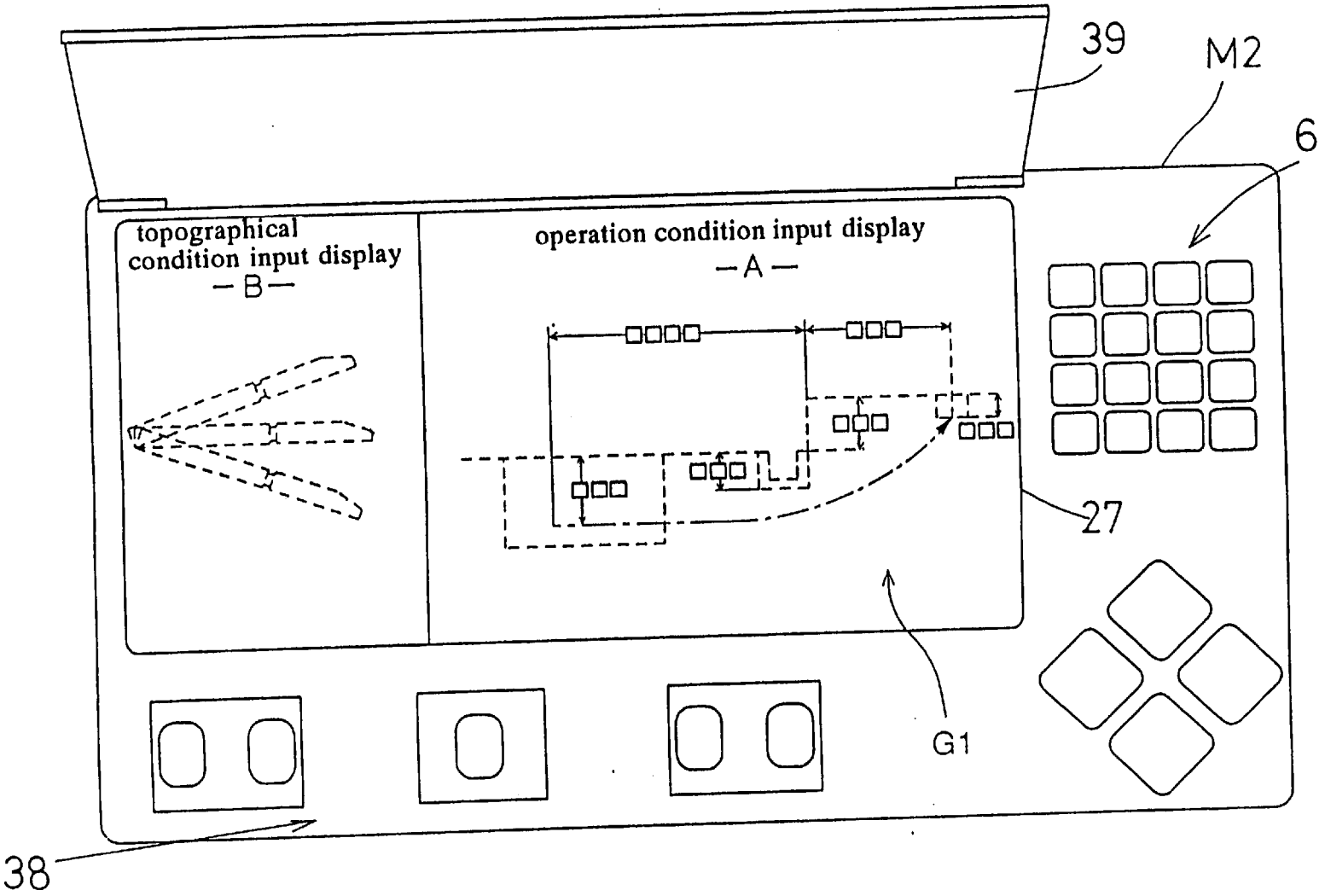
FIG. 37 is a schematic view showing a control panel and a first screen of the propellant apparatus of FIG. 36.

Incidentally, the control panel of the propelling control device M2 is shown in FIG. 37. This propelling control device M2 includes a setting input section 6, a display section 27 and an operation control section 38. Of these components, the setting input section 6 is for allowing inputs of the topographical conditions A such as the terrain of the site where the pipe is to be installed and the various operation conditions B of the propellant apparatus S. The display section 27 displays the inputted topographical conditions A and operation conditions B and displays also, during the propelling operation, the posture and position of the propellant apparatus S and so on. This display section 27 is constructed of a liquid crystal display panel or the like. Further, a cover member 39 is provided for closing and opening this display section 27. This cover member 39 protects the display section 27 during storage and transportation of the propelling control device M2. Further, the cover member 39 functions as a light sun shield for assuring visibility of the display section 27 under the sun light. The operation control section 38 effects the thrusting and withdrawing operations of the propellant apparatus S and rotating operation of the pressure receiving face portion F of the propellant head 1.

Figure 38:
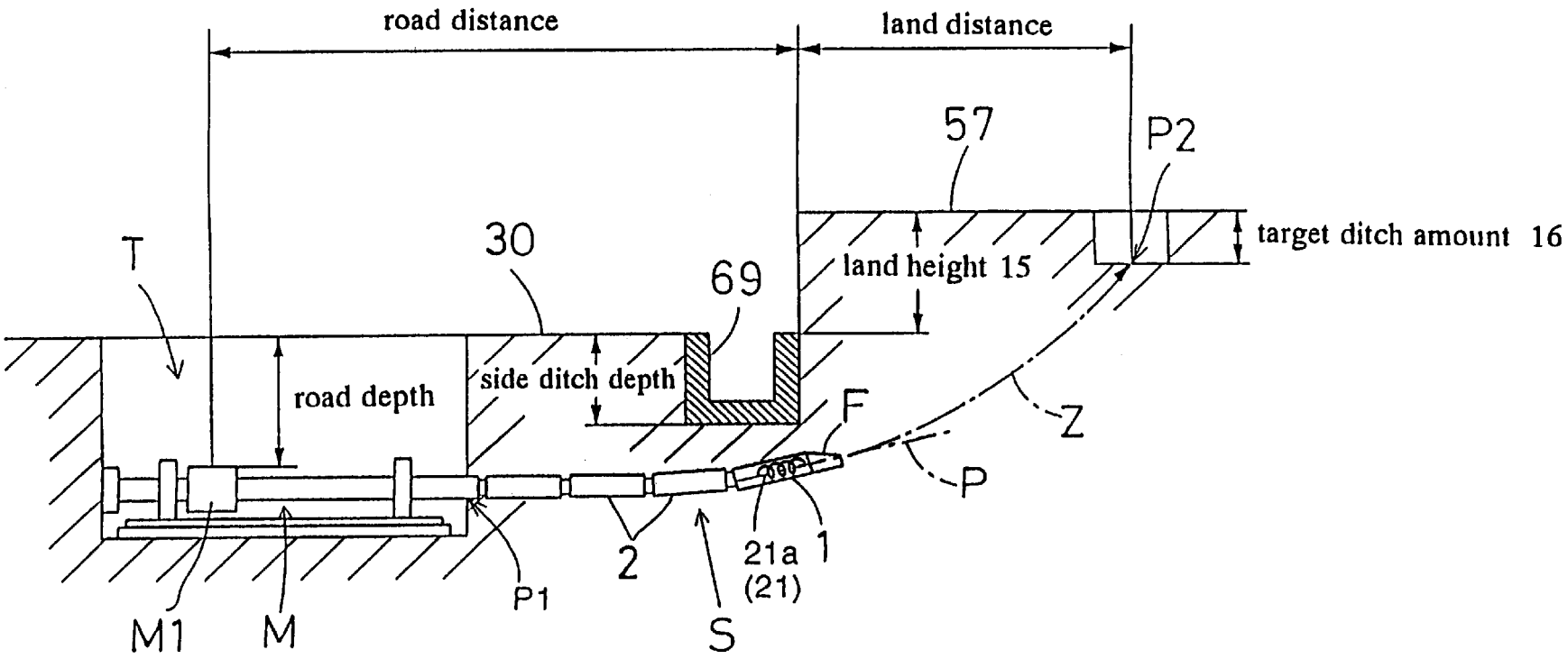
FIG. 38 is a view illustrating a terrain condition.

Further, FIG. 38 shows an example of the topographical conditions. The topographical conditions A extending from the installed position of the thrust device M, i.e. the start point P1, to the target point P2 and the operation conditions B relating to e.g. the direction for starting the propelling operation of the propellant head 1, are inputted via the control panel of the propelling control device M2.

In the above, the topographical conditions to be inputted may include: a road depth 70 from the surface of a road 30 to the thrust device M; a depth 71 from the road 30 to a side ditch 69; a land height 15 from the road 30 to a land 57; a target ditch amount 16 provided in advance at the target point that the propellant head 1 has to reach; a road distance 67 from the thrust device M to the limit of the land; and a land distance 68 from the land limit to the target point P2.

On the other hand, as the operation conditions, the start direction of starting the propelling of the propellant apparatus S is inputted. As this propelling start direction, any one of the three kinds, upward, horizontal and downward directions may be selected. And, these conditions should be determined with consideration to the terrain to which the propelling method is to be implemented, i.e. the position relationship between the start point P1 and the target point P2 or distance therebetween, or presence/absence of an obstacle present therebetween.

Figure 41:
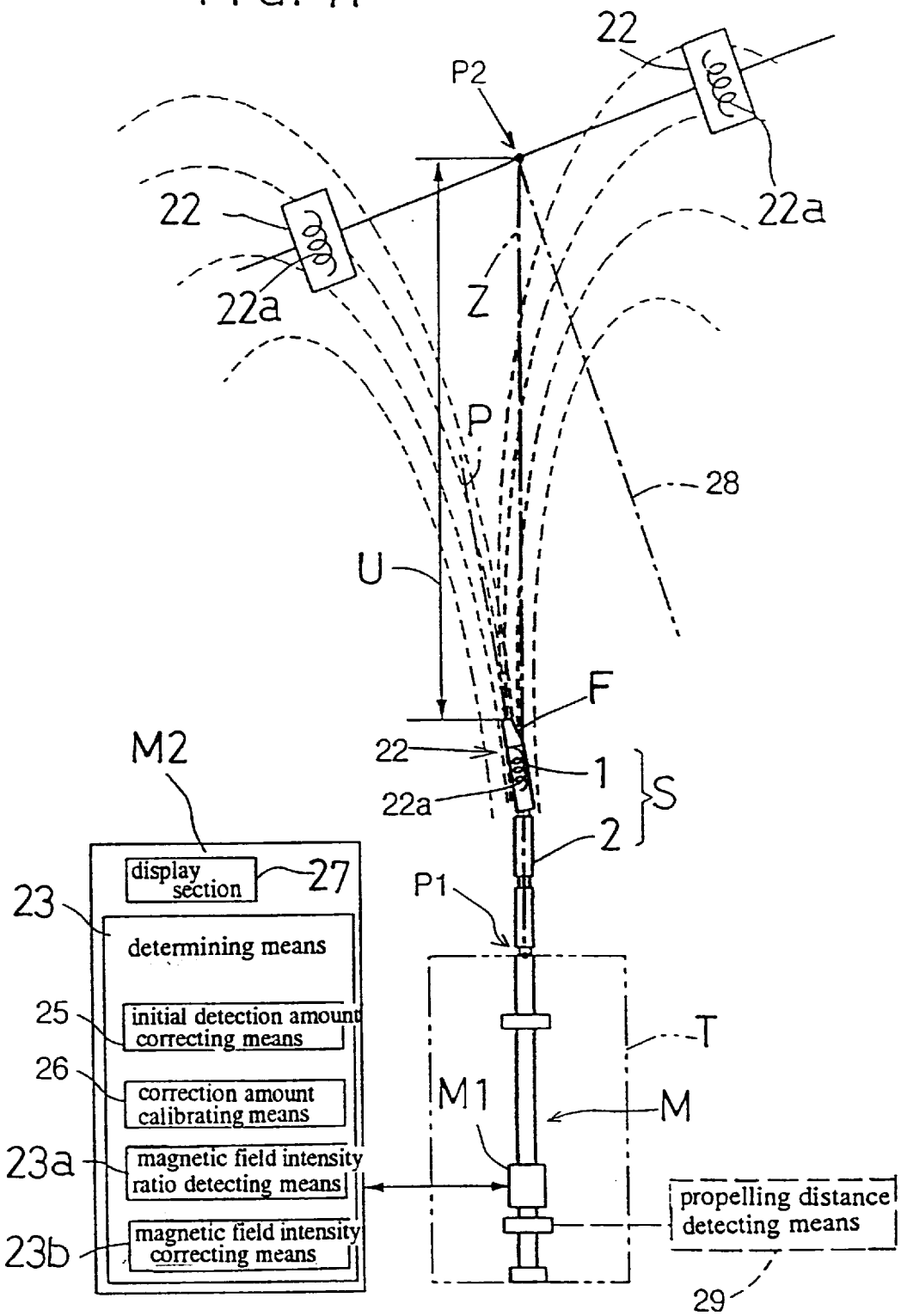
FIG. 41 is a schematic view showing a top outer appearance of a propellant apparatus for use in a still further embodiment of the present invention.

(9) A still further embodiment of the invention will be described next with reference to FIG. 41.

The construction of this embodiment includes initial detection amount correcting means and correction amount calibrating means, in addition to the magnetic field intensity correcting means.

More particularly, the initial detection amount correcting means 25 allows the display section 27 to display, on the second display screen G2, the current propelling condition of the propellant head 1 with correction thereof.

For instance, the pair of receiver coils 22*a* may not be disposed correctly relative to the planned propelling path Z, e.g. when there exists an obstacle at the target point P2. In this case, although the propellant head 1 may be actually located on the planned propelling path Z, the position will be deviated from a level line 28 determined by the pair of receiver coils 22*a,* so that on the display section 27, the position of the propellant head 1 at the start of the propelling operation will be deviated from the planned propelling path Z.

Then, the initial detection amount correcting means 25 is used for calibrating the ratio between the intensities of the magnetic fields generated at the respective receiver coils 22*a,* so as to align the displayed position of the propellant head 1 on the display section 27 with the planned propelling path Z. With this, the setting difference in the level line 28 may be substantially compensated for, so that the operator of the propelling operation may control the steering of the propellant head 1 with natural operation feel.

Further, the determining means 23 includes the correction amount calibrating means 26 for reducing the amount of position calibration between the level line 28 and the planned propelling line Z, in accordance with the propelling distance of the propellant head 1, in consideration of the fact that the level line 28 and the planned propelling path Z come closer to each other as the propellant head 1 approaches the target point P2. That is to say, the calibration amount of the magnetic field detection value obtained at the time of start of the propelling operation (to be referred to briefly as 'initial calibration amount' hereinafter) is reduced in accordance with the propelling distance of the propellant head 1, thereby to obtain a secondary calibration amount.

In the calculation of the secondary calibration amount, it is conceivable to decrease the initial calibration amount according to a linear function in accordance with the propelling distance of the propellant head 1. Instead, however, the secondary calibration amount may be obtained from the initial calibration amount by using a n-th function, with consideration to e.g. the characteristics of the receiver coils 22*a* and/or the characteristics of the transmitter coil 21*a*.

With use of the correction amount calibrating means 26, even when the propellant head 1 is located at a certain point on the planned propelling path Z, the initial position difference between the level line 28 and the planned propelling line Z may be calibrated, so that the propelling condition of the propellant head 1 may be displayed accurately on the display section 27. Incidentally, the secondary calibration value will be added to the magnetic field intensity ratio obtained by the magnetic field intensity ratio detecting means 23*a* described hereinbefore, and the display section 27 will display the propelling condition of the propellant head 1 after the addition of the secondary calibration amount.

With the propellant apparatus having the above-described construction, even when the receiver coils 22*a* are not installed correctly and the level line 28 does not agree to the planned propelling line Z, the orientation or position of the propellant head 1 may be accurately displayed on the second display screen of the display section 27 with solving the apparent position difference of the propellant head 1.

Therefore, with observing this display, the operator of the propelling operation may steer the propellant head 1 accurately.

Further, with the above-described propellant apparatus, there is less necessity of agreeing the level line 28 to the planned propelling path Z when the receiver coils 22*a* are initially installed. Consequently, the disposing operation of the receiver coils 22*a* may be facilitated, so that the entire underground propelling operation may be effected speedily.

(10) A still further embodiment of the invention will be described next.

This embodiment relates to a propelling control display system capable of recognizing a position of the propellant apparatus for use in a propelling method of the present invention.

In a display of the second display screen G2 shown in FIG. 39, in a side view display, the distance axis schematically representing the horizontal distance is disposed along the lateral direction and the height axis schematically representing the vertical height is disposed along the vertical direction, respectively. However, the distance axis may not necessarily be displayed on the second display screen G2. This second display screen G2 schematically displays the respective positions with maintaining the relationship of magnitudes of the coordinated values of the respective points constituting the planned propelling path Z, the coordinated values of the propellant head and so on. And, this screen may accurately display the lateral and vertical relationships among these based on the topographical conditions A.

Incidentally, the above display accurately reflect the relationships only when the respective positions of the topographical data and the position of the propellant head 1 are located on the upper or lower or the right or left side; and when distances between certain two points are compared, the display does not necessarily accurately reflect the actual ratio therebetween.

During a propelling operation, in the case of a side view display in particular, there is displayed a deviation distance of the propellant head 1 in the vertical direction relative to the planned propelling line Z. And, this deviation distance is displayed in such a manner that magnitude of the actual deviation distance may be compared.

On the other hand, in a plan view display, there is displayed the direction of the axis X of the propellant head 1 relative to the planned propelling path Z. The greater this deviation, the farther the propellant head 1 will be displayed relative to the planned propelling path Z.

Supposing the propellant head is oriented to the left toward the target point P2, in the plan view display of the second display screen G2, the position of the propellant head 1 will be plotted on the left side relative to the planned propelling path Z. The distance between this plotted position and the planned propelling path Z will be displayed greater, the greater the deviation of the orientation of the propellant head 1 relative to the target point P2. However, the plan view displays the right or left deviation of the propellant head 1 relative to the planned propelling path Z and the current orientation of the propellant head 1 and the amount of this orientation in a combined state.

The side view display and the plan view display described above are displayed on the second display screen G2 after lapse of a certain unit time period or after propelling over a certain unit distance. And, these displays will be made in accordance with correlating e.g. the deviation amount of the propellant head 1 relative to the planned propelling path Z with the actual terrain. Accordingly, the operator may accurately and naturally grasp the current position of the propellant head 1 and may readily and speedily correct the propelling direction of the propellant head 1 when necessary.

(11) In the foregoing embodiments, each of all the propellant cylinders has one pivotal flexion axis, i.e. each cylinder is pivotal in one direction alone; and all the axes of these cylinders are disposed in parallel with each other. Instead, only the one propellant cylinder directly connected to the rear end of the propellant head may have such construction, while the other subsequent propellant cylinders may be constructed in the conventional ommnidirectionally pivotal type (multiple pivot axis type).

(12) It is also conceivable to construct the entire propellant apparatus S to be flexed about a predetermined axis (e.g. a virtual point on the ground surface). Such construction will be preferred in case the propelling distance is short and the target point is not very far, since the construction will allow use of very simple control mechanism.

The invention may be embodied in other specific forms without departing from the spirit or essential characteristics thereof. The present embodiments are therefore to be considered in all respects as illustrative and not restrictive, the scope of the invention being indicated by the appended claims rather than the foregoing description and all changes which come within the meaning and range of equivalency of the claims are therefore intended to be embraced therein.

What is claimed is:

1. An underground propelling method comprising the steps of:

using a propellant apparatus including a propellant head having a pressure receiving face portion inclined relative to an axis of the head and a plurality of propellant cylinders flexibly and pivotally connected in series to a rear end of the propellant head; and propelling the propellant apparatus under the ground by applying a thrust to the propellant apparatus from behind;

wherein each propellant cylinder is pivotal about a single pivot axis thereof alone; and the propellant apparatus is propelled with the pressure receiving face portion thereof being oriented along a pivotal direction of the propellant cylinder about the pivot axis.

2. A method according to claim 1, wherein the propellant head includes a leader portion which is pivotal relative to the body of the propellant head; and when the propellant head comes into contact with an underground obstacle during the propellant movement, the leader portion is pivoted in such a manner as to substantially register the pivot axis with the orientation of the pressure receiving face portion in the direction of the head axis.

3. A method according to claim 1, wherein the propellant head includes a leader portion which is pivotal relative to the body of the propellant head; and when the propellant head comes into contact with an underground obstacle during the propellant movement, the leader portion is pivoted in such a manner as to substantially register the pivot axis with the orientation of the pressure receiving face portion in the direction of the head axis; and when the obstacle cannot be pushed away, the apparatus is detoured with pivoting the leader portion about the head axis in such a manner as to cause the pivot axis and the orientation of the pressure receiving face portion to extend transversely as viewed from the direction of the head axis.

4. A method according to claim 1, wherein when the propellant apparatus is propelled into the earth as receiving thrust force from behind, the propellant apparatus is propelled through a pit mouth of a pit mount support member disposed adjacent thereto.

5. A method according to claim 4, wherein, in an initial propellant stroke for propelling the propellant apparatus into and through the pit mouth, the apparatus is propelled with setting the orientation of the pressure receiving face portion to cause the propellant apparatus to be flexed to an opposite side to the side of a planned path, and in a subsequent propellant stroke, the apparatus is propelled with setting the orientation of the pressure receiving face portion to cause the propellant apparatus to be flexed to the side of the planned path.

6. A method according to claim 1, wherein the method further comprises: a lateral propelling step for propelling the propellant head from a first underground point to a second underground point along the surface of the ground; and an ascending propelling step of propelling the propellant head from the second underground point to a predetermined third ground-surface point.

7. A method according to claim 6, wherein during the lateral propelling step, vertical steering characteristics of the propellant head relative to the ground conditions are obtained and stored in record; and during the ascending propelling step, the obtained and stored characteristics are utilized for reckoning a propelling path thereby to determine the location of the second point.

8. A method according to claim 1, wherein the propellant head includes a transmitter coil and a receiver device is installed in advance at the target ground-surface point for the propellant head; and as the transmitter coil of the propellant head transmits an electromagnet wave and this wave is received by a receiver coil of the receiver device, a deviation amount of the apparatus is reckoned to control the steering direction of the propellant head.

9. A method according to claim 8, wherein a depression angle formed between the axes of the receiver coils and the horizontal plane is automatically adjusted so as to allow the receiver coils to obtain signal of maximum intensity.

10. An underground propelling method comprising the steps of:

using a propellant apparatus including a propellant head having a pressure receiving face portion inclined relative to an axis of the head and a plurality of propellant cylinders flexibly and pivotally connected in series to a rear end of the propellant head; and propelling the propellant apparatus under the ground by applying a thrust to the propellant apparatus from behind;

wherein each propellant cylinder is pivotal about a single pivot axis thereof alone; and in a curved path, the propellant apparatus is propelled with the pressure receiving face portion thereof being oriented along a pivotal direction of the propellant cylinder about the pivot axis; and in a straight path, the propellant apparatus is propelled with the pressure receiving face portion thereof being oriented along the pivot axis of the propellant cylinder.

11. A method according to claim 10, wherein the propellant head includes a leader portion which is pivotal relative to the body of the propellant head; and when the propellant head comes into contact with an underground obstacle during the propellant movement, the leader portion is pivoted in such a manner as to substantially register the pivot axis with the orientation of the pressure receiving face portion in the direction of the head axis.

12. A method according to claim 10, wherein the propellant head includes a leader portion which is pivotal relative to the body of the propellant head; and when the propellant head comes into contact with an underground obstacle during the propellant movement, the leader portion is pivoted in such a manner as to substantially register the pivot axis with the orientation of the pressure receiving face portion in the direction of the head axis; and when the obstacle cannot be pushed away, the apparatus is detoured with pivoting the leader portion about the head axis in such a manner as to cause the pivot axis and the orientation of the pressure receiving face portion to extend transversely as viewed from the direction of the head axis.

13. A method according to claim 10, wherein when the propellant apparatus is propelled into the earth as receiving thrust force from behind, the propellant apparatus is propelled through a pit mouth of a pit mount support member disposed adjacent thereto.

14. A method according to claim 13, wherein, in an initial propellant stroke for propelling the propellant apparatus into and through the pit mouth, the apparatus is propelled with setting the orientation of the pressure receiving face portion to cause the propellant apparatus to be flexed to an opposite side to the side of a planned path, and in a subsequent propellant stroke, the apparatus is propelled with setting the orientation of the pressure receiving face portion to cause the propellant apparatus to be flexed to the side of the planned path.

15. A method according to claim 10, wherein the method further comprises: a lateral propelling step for propelling the propellant head from a first underground point to a second underground point along the surface of the ground; and an ascending propelling step of propelling the propellant head from the second underground point to a predetermined third ground-surface point.

16. A method according to claim 15, wherein during the lateral propelling step, vertical steering characteristics of the propellant head relative to the ground conditions are obtained and stored in record; and during the ascending propelling step, the obtained and stored characteristics are utilized for reckoning a propelling path thereby to determine the location of the second point.

17. A method according to claim 10, wherein the propellant head includes a transmitter coil and a receiver device is installed in advance at the target ground-surface point for the propellant head; and as the transmitter coil of the propellant head transmits an electromagnet wave and this wave is received by a receiver coil of the receiver device, a deviation amount of the apparatus is reckoned to control the steering direction of the propellant head.

18. A method according to claim 17, wherein a depression angle formed between the axes of the receiver coils and the horizontal plane is automatically adjusted so as to allow the receiver coils to obtain signal of maximum intensity.

* * * * *